US009828855B2

(12) United States Patent
Nelson

(10) Patent No.: US 9,828,855 B2
(45) Date of Patent: Nov. 28, 2017

(54) BOLT PLATE MAGAZINE AND CENTRALIZER

(71) Applicant: 1311854 ONTARIO LIMITED, Elliot Lake (CA)

(72) Inventor: Yves Nelson, Algoma Mills (CA)

(73) Assignee: 1311854 ONTARIO LIMITED, Elliot Lake, CA (US)

( * ) Notice: Subject to any disclaimer, the term of this patent is extended or adjusted under 35 U.S.C. 154(b) by 0 days.

(21) Appl. No.: 14/693,507

(22) Filed: Apr. 22, 2015

(65) Prior Publication Data

US 2016/0305243 A1 Oct. 20, 2016

(30) Foreign Application Priority Data

Apr. 16, 2015 (CA) ..... 2888184

(51) Int. Cl.
*E21D 20/00* (2006.01)
*E02D 5/80* (2006.01)

(52) U.S. Cl.
CPC ..... *E21D 20/006* (2013.01); *E02D 5/80* (2013.01)

(58) Field of Classification Search
CPC combination set(s) only.
See application file for complete search history.

(56) References Cited

U.S. PATENT DOCUMENTS 3,218,893 A * 11/1965 Madison ..... E21D 20/006 144/103
3,670,387 A * 6/1972 Nagao ..... B23P 19/006 221/251
4,226,559 A * 10/1980 Prebensen ..... E21B 7/025 173/184
5,556,235 A 9/1996 Morrison et al.
5,597,267 A 1/1997 Morrison et al.
5,720,582 A * 2/1998 Morrison ..... E21D 20/006 29/809
6,302,310 B1 * 10/2001 Lamb ..... B25C 1/006 221/232
6,413,019 B1 * 7/2002 Coombs ..... E21D 20/006 173/38
2004/0177979 A1 * 9/2004 Rubie ..... E21B 19/087 173/28

OTHER PUBLICATIONS

Office Action dated Apr. 26, 2016 in corresponding Canadian Application No. 2,888,184.
Office Action dated Apr. 26, 2016 in corresponding Canadian Patent Application No. 2,888,184, 3 pages.

* cited by examiner

*Primary Examiner* — Kyle Armstrong
(74) *Attorney, Agent, or Firm* — Faegre Baker Daniels LLP

(57) ABSTRACT

A rock bolting system rock bolting system comprising a frame supporting a movable bolter feed rail, a bolter feed slidable on the bolter feed rail, the bolter feed having a bolt driver for driving a rock bolt into a drilled hole in a rock face, a plate magazine for storing a plurality of bolt plates, and a plate holder for holding a plate to enable the plate to function as a centralizer to centralize the bolt.

9 Claims, 25 Drawing Sheets

BOLT PLATE MAGAZINE AND CENTRALIZER

CROSS-REFERENCE TO RELATED APPLICATIONS

This Application claims priority to Canadian Patent Application No. 2,888,184, filed Apr. 16, 2015, by the Applicant, 1311854 Ontario Limited and entitled "BOLT PLATE MAGAZINE AND CENTRALIZER," the entire disclosure of which is hereby incorporated by reference herein.

TECHNICAL FIELD

The present invention relates generally to mining equipment and, in particular, to rock bolting.

BACKGROUND

In a mine, ground support, e.g. rock bolts and screening, is used to prevent rock falls. Several different types of rock bolts may be used but all require that holes be drilled in the rock first. This is done with equipment known as rock bolters. These are mobile units with a bolting head attached. To drill a hole in the rock to install ground support, the bolting head is placed against the rock face (which is called "stinging the face") and then a hole is drilled into the rock. The unit is then indexed to install the rock bolt as ground support.

In conventional rock bolting, the plates are already loaded on the bolts by hand before the bolts are mounted on the bolting carousel of the rock bolter. A hydraulically operated carousel loading system enables the operator to load the bolts one at a time into position for bolting. The current bolt turret/carousel capacity is a maximum of ten bolts. Manual loading of plates is time-consuming. Furthermore, conventional rock bolters also require a separate centralizer to centralize the bolts.

In view of these shortcomings of the prior art, an improved rock bolting system remains highly desirable.

SUMMARY

In broad terms, one aspect of the present disclosure provides a novel rock bolting technique that enables plates to be loaded automatically, thereby improving speed and productivity in rock bolting operations. Embodiments of the present disclosure also utilizes each plate as a centralizer, thereby eliminating the need for a separate centralizer for the rock bolter.

Accordingly, one inventive aspect of the present disclosure is a rock bolting system comprising a frame supporting a movable bolter feed rail, a bolter feed slidable on the bolter feed rail, the bolter feed having a bolt driver for driving a rock bolt into a drilled hole in a rock face, a plate magazine for storing a plurality of bolt plates, and a plate holder for holding a plate to enable the plate to function as a centralizer to centralize the bolt.

Another inventive aspect of the present disclosure is a method of installing a rock bolt using a rock bolting system having a frame supporting a movable bolter feed rail, the method comprising storing a plurality of bolt plates in a plate magazine, holding a plate in a plate holder to enable the plate to function as a centralizer to centralize the bolt, and driving the rock bolt into a hole in a rock face.

Yet another inventive aspect of the present disclosure is a rock bolting system comprising a frame supporting a movable bolter feed rail, a bolter feed slidable on the bolter feed rail, the bolter feed having a bolt driver for driving a rock bolt into a drilled hole in a rock face, a plate magazine for storing a plurality of bolt plates, and a plate holder for holding a plate to enable the bolt to engage the plate.

This summary is provided to highlight certain significant inventive aspects but is not intended to be an exhaustive or limiting definition of all inventive aspects of the disclosure. Other inventive aspects may be disclosed in the detailed description and drawings.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals. It should furthermore be noted that the drawings are not necessarily to scale.

DETAILED DESCRIPTION

Figure 1:
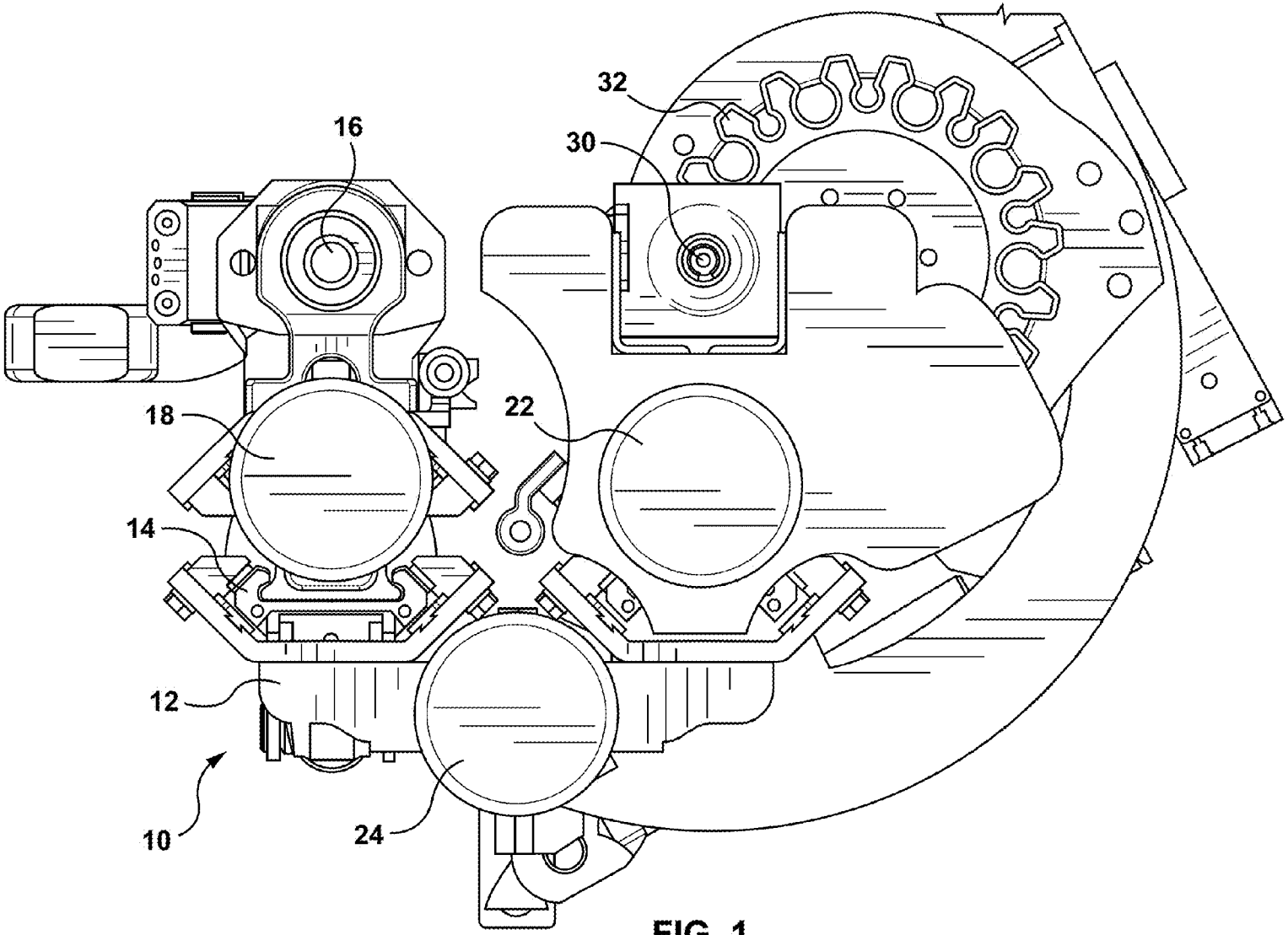
FIG. 1 depicts the system indexed into a bolt loading position.
Figure 2:
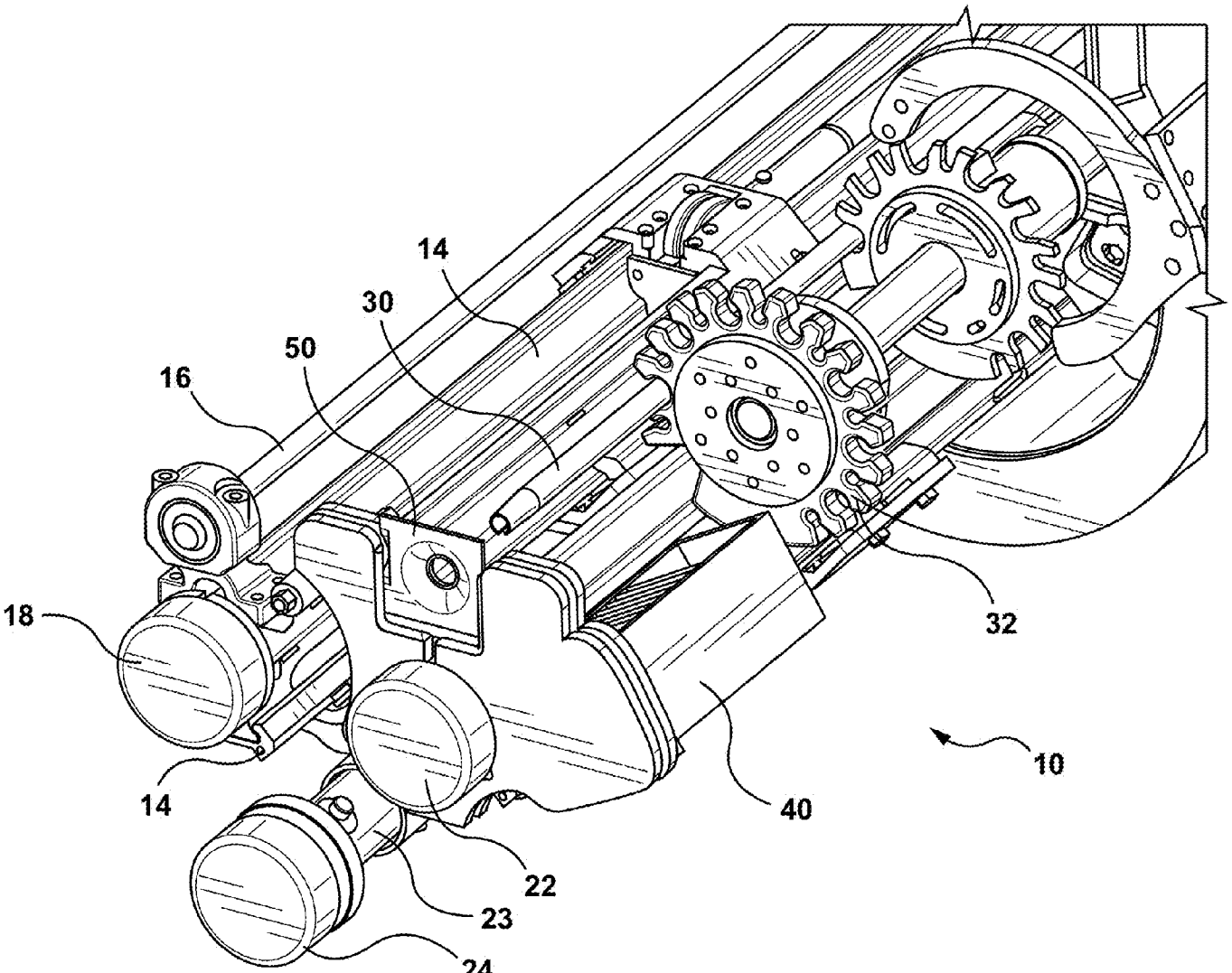
FIG. 2 depicts the carousel turning into the loading position.

In general, embodiments of the present disclosure provides a novel rock bolting system and method. The system and method utilize a plate magazine (or case) that stores bolt a plurality of bolt plates. The system also includes a mechanism to load the plates, either automatically (i.e. by hydraulic or pneumatic actuation) or manually, into a bolting position in which the plate optionally acts as a centralizer to centralize the bolt. In other words, the plate may act as a centralizer in one set of embodiments. In other embodiments, the plate need not perform a centralizing function in which case the bolt merely engages the plate to carry the plate to the rock face.

This novel system and method provide an alternate way of loading bolts which improves the bolt capacity on the bolting carousel. Improving the bolt capacity reduces the downtime attributed to loading bolts. This increases the productivity of the bolter unit. By innovatively using the plate as the centralizer, this novel system also reduces the number of parts required to centralize the bolt.

The rock bolting system depicted by way of example in the figures includes a plate magazine. In one embodiment, this magazine may be spring loaded, hydraulic cylinder loaded, or pneumatic cylinder loaded. Ability to store and feed plates. A lock pin holds the plates in place until actuated by the arm moving back into loading position. Once in loading position, the pin releases and the spring feeds the next plate into the arm. Once the arm is pushed into centralizer position, the pin is re-activated to hold the remaining plates in the magazine.

The manual style plate centralizer design also has an optional plate magazine holder/dispenser which the operator can store plates near the front end of the feed beam. This makes the plates easily accessible for the operator.

The system also includes a centralizer plate holder that enables the plates to be used as a centralizer, eliminating the need for a separate centralizer unit. The centralizer plate holder either houses magnets to hold the plates in position, or uses a polyurethane seal to hold the plates into position until they are pushed out by the drifter (bolting feed). The centralizer plate holder can either be moved linearly or in rotary motion by hydraulic, electric, or manual actuation.

The centralizer plate holder also enables the operator to load plates into a centralizer position on the front of the beam, so that the plate can be used as a centralizer. The plate holder will hold the plates into position firmly by either hydraulic, pneumatic, or mechanical means, until the drifter pushes through the mechanism and onto the wall.

The system may include a stinger plate designed to enclose the entire mechanism in order to shield the components from debris and to ensure that the plate will not fall out of the system no matter which orientation the feed is in.

In the embodiment illustrated in FIGS. 1-8, the rock bolting system designated generally by reference numeral 10 includes a frame 12. The frame may be attached or mounted to a wheeled vehicle (e.g. a jumbo drilling rig or bolting jumbo) for transporting the rock bolting system inside a mine to the rock face where ground support is to be installed. The frame 12 supports a drill feed rail 14 upon which a drill feed can slide. The drill feed advances a drill steel 16. The drill feed rail may have a pad 18 at its forward end. The frame also supports a bolter feed rail 20. A bolter feed 25 is slidable via a carriage 21 on the bolter feed rail 20. The bolter feed has a bolt driver for driving a rock bolt 30 into a drilled hole in a rock face. The bolter feed has a pad 22. A stinger 23 with a stinger pad 24 extends hydraulically to sting (i.e. engage) the rock face to stabilize the rock bolting system during drilling and bolting operations. A rotatable carousel 32 rotates to load each bolt into the bolting feed. An indexing mechanism may be provided to index the bolting feed into position after the hole has been drilled. The indexing mechanism also rotates the drilling feed out of position to make room for the bolting feed.

In the embodiment illustrated in FIGS. 1-8, the rock bolting system 10 includes a plate magazine 40 for storing a plurality of bolt plates 50. Bolt plates are also known as bearing plates or washers. As shown by way of example in the figures, the plates may be substantially square (although other shapes such as rectangular plates may be used in variants). Each plate has a central hole dimensioned to receive the bolt. It should be noted that although a central hole is depicted the hole may be off-center in other embodiments. Each plate may, as shown by way of example in the illustrations, have a tapered (domed) region extending in a rearward direction beyond the plane of the plate. In lieu of domed plates, any other suitable type of bolt plates may be utilized in other embodiments such as, for example, flat plates, slotted plates and ribbed plates. The magazine 40 may store the plurality of plates 50 in a face-to-face configuration as shown in FIGS. 5-8.

The rock bolting system 10 also includes a plate holder 60 for holding a plate 50 to enable the plate 50 to function as a centralizer to centralize the bolt 30. For the purposes of this specification, the plate holder is also referred to as a centralizer plate holder.

Method of Operation

Figure 3:
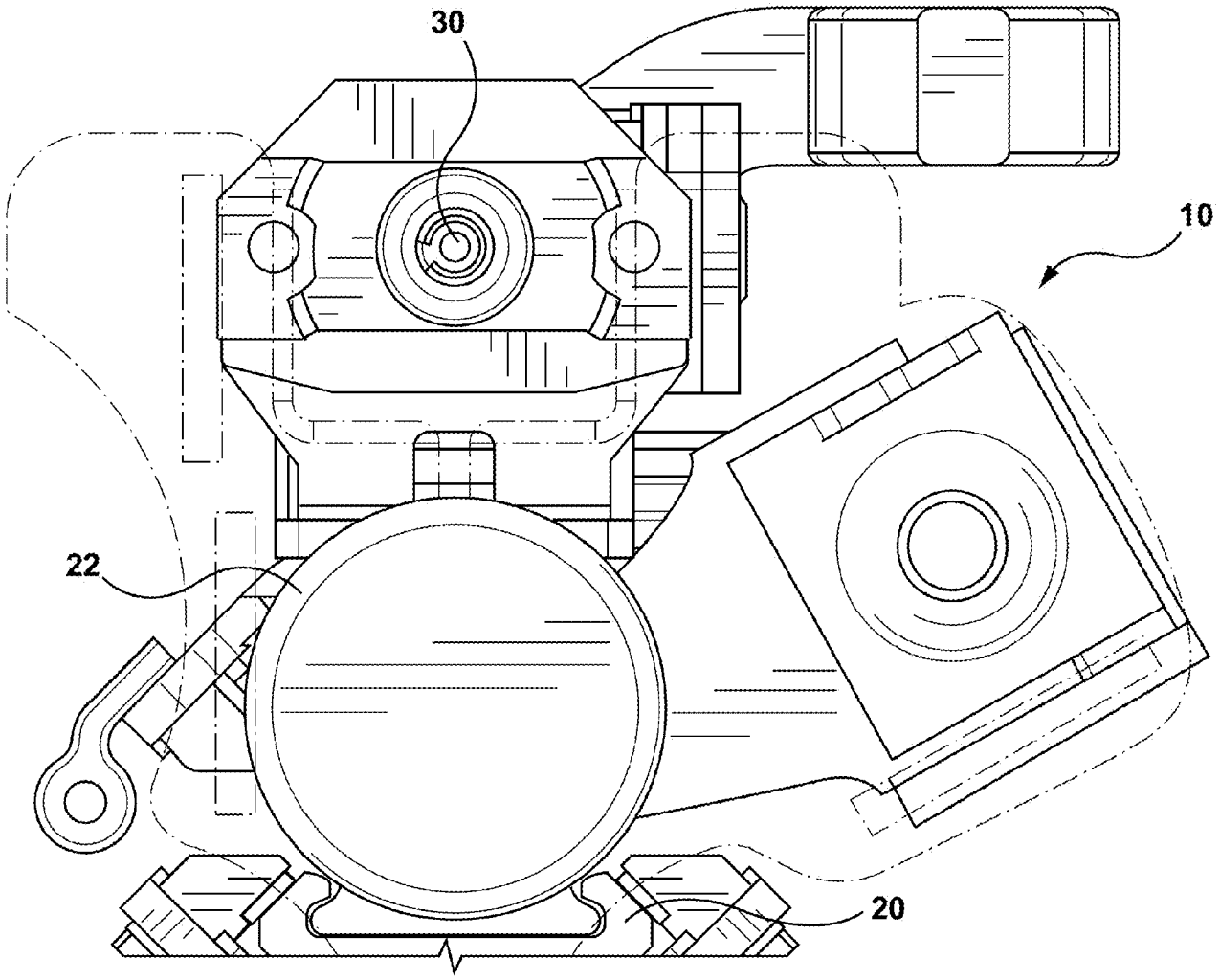
FIG. 3 depicts a plate loading configuration.
Figure 4:
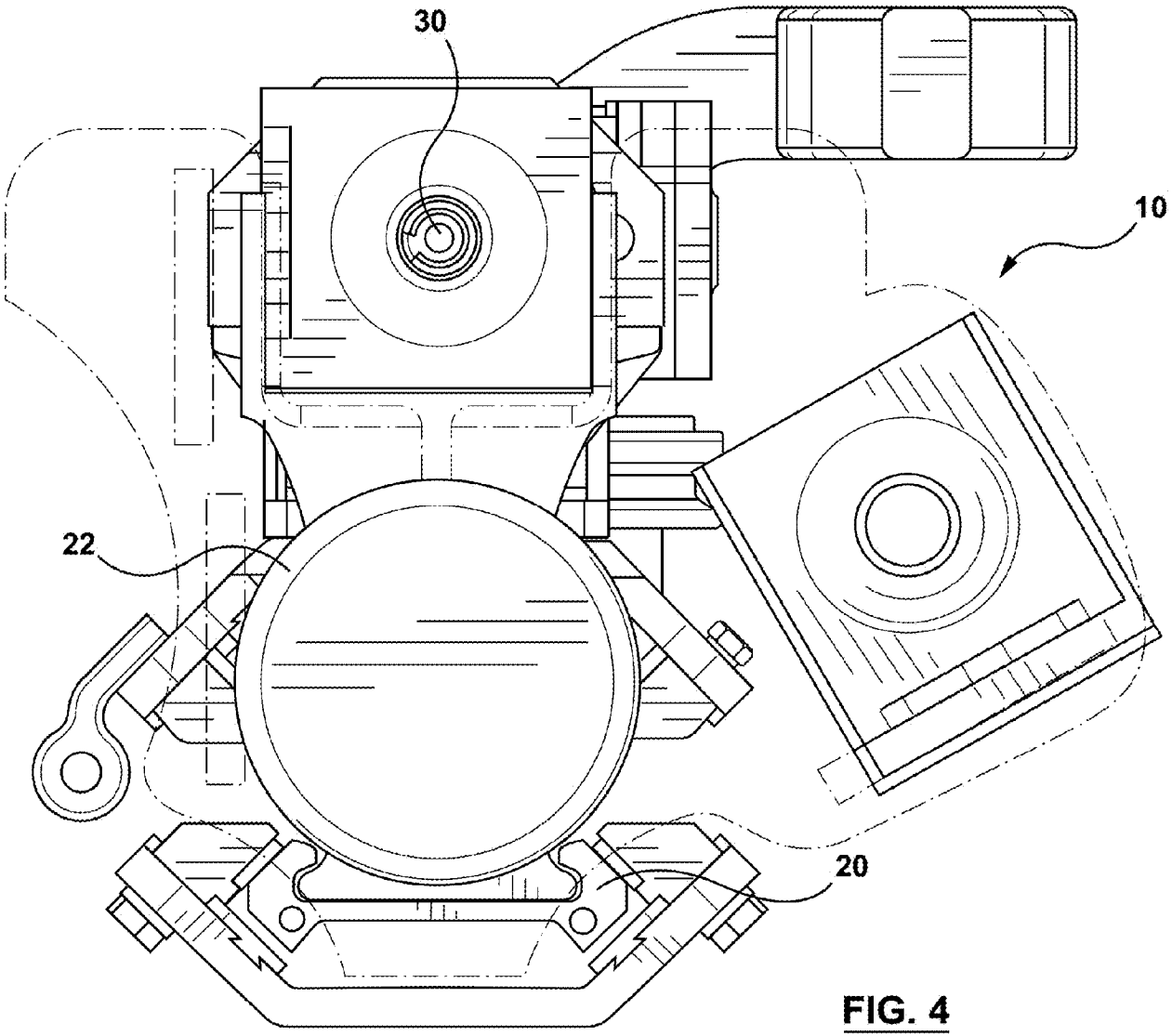
FIG. 4 depicts a plate centralizer position.
Figure 5:
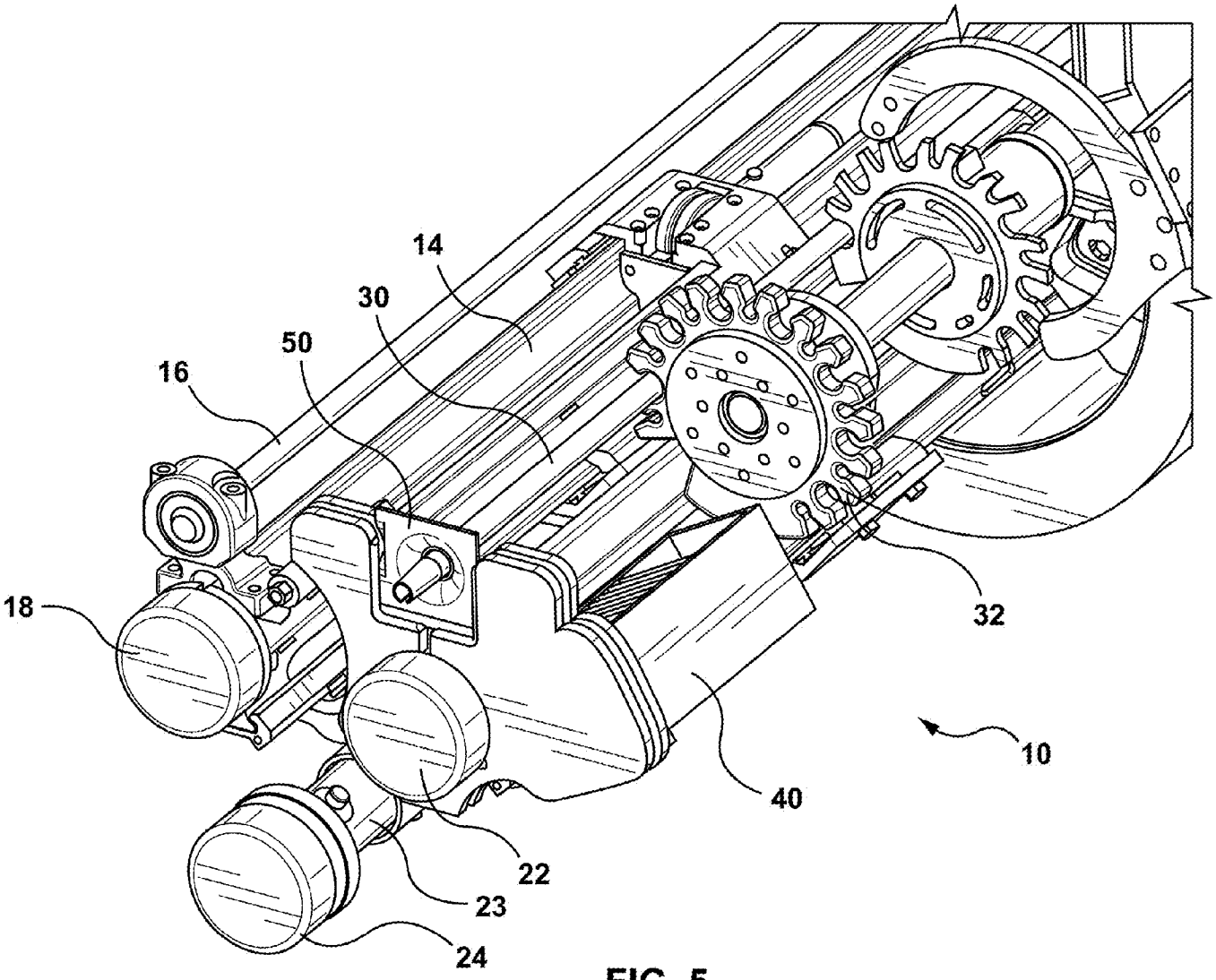
FIG. 5 depicts a bolt loaded position.
Figure 6:
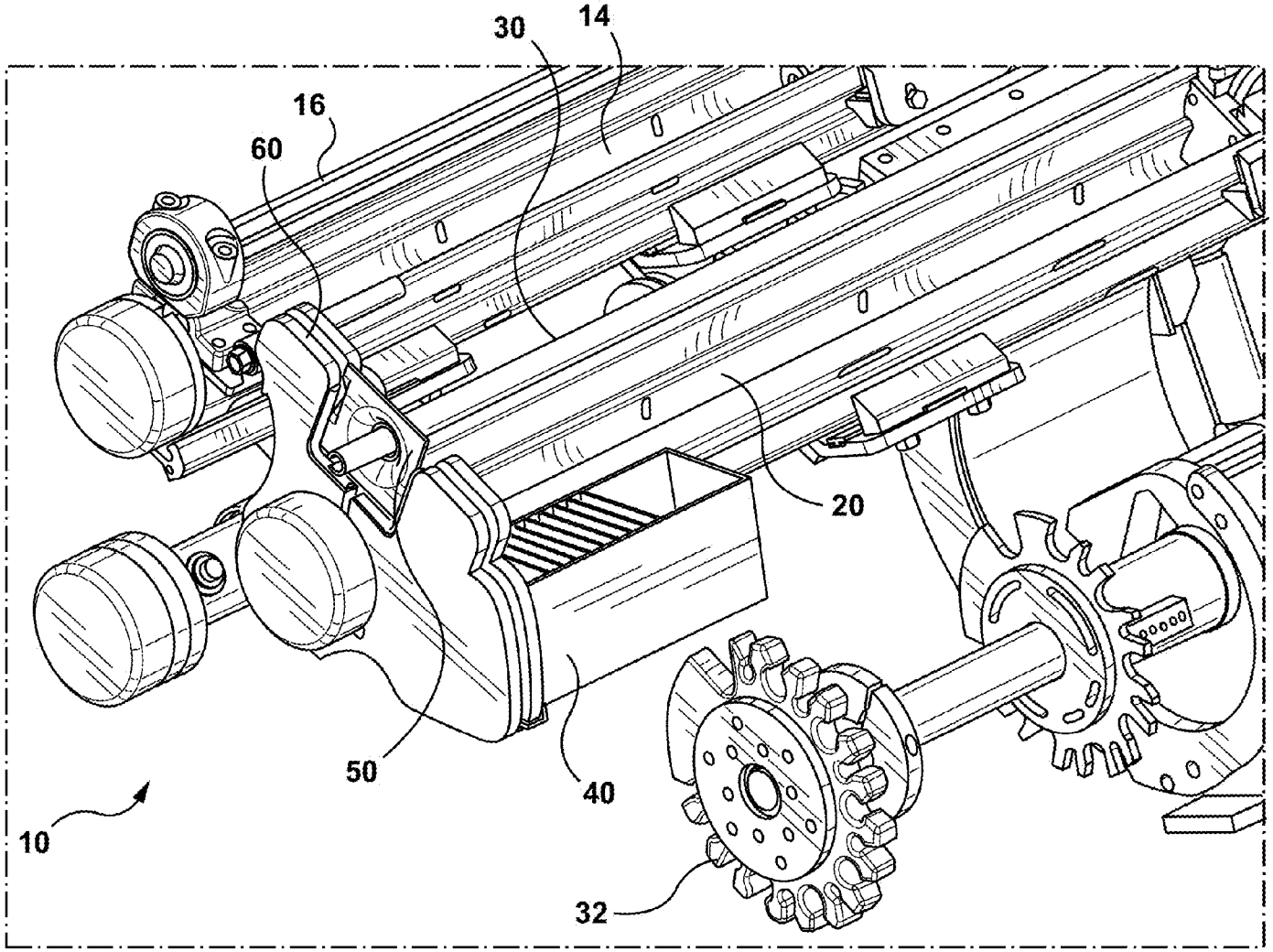
FIG. 6 depicts the system indexed out to the bolting position.
Figure 7:
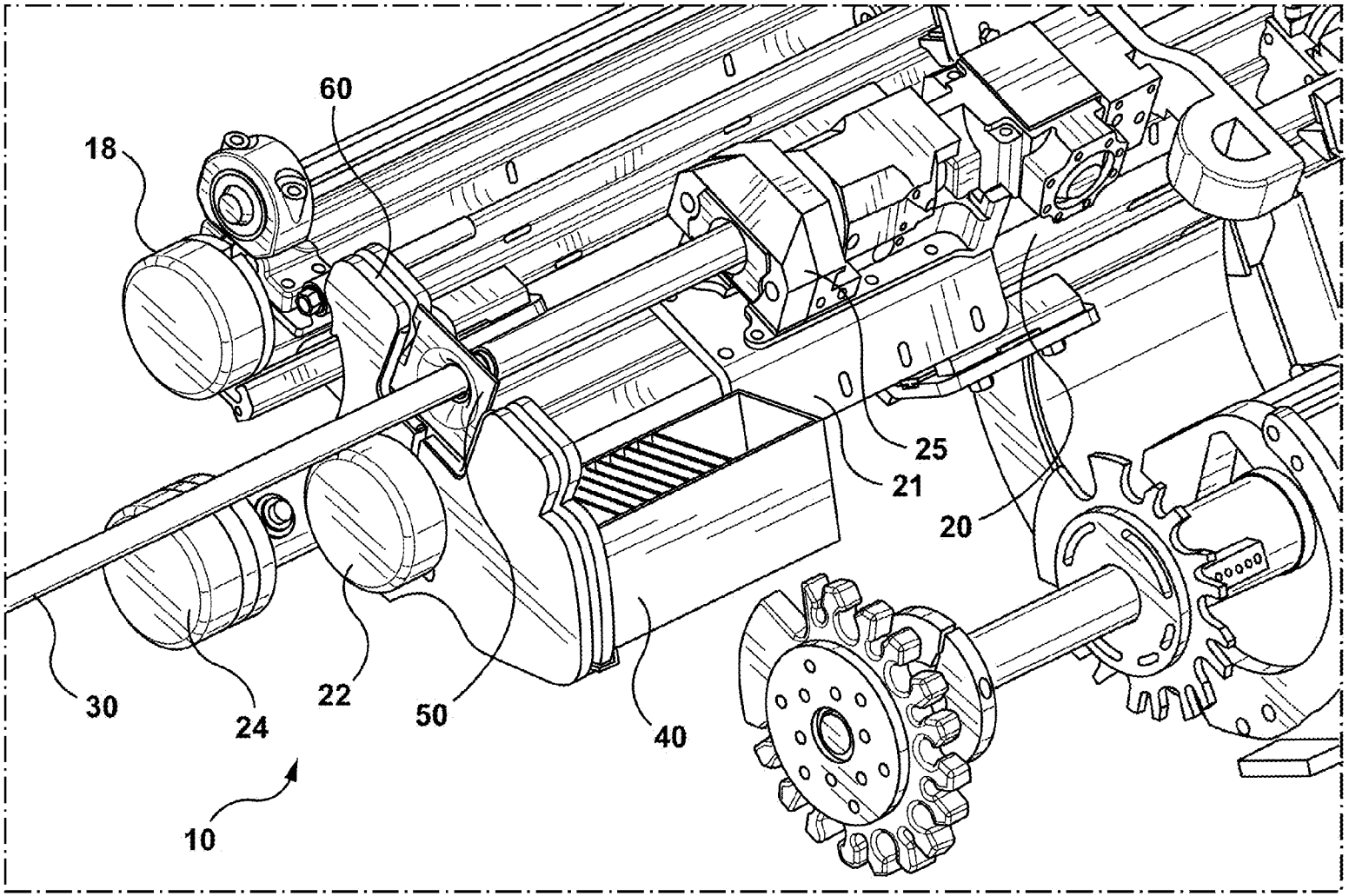
FIG. 7 depicts the bolt advancing through the plate with the plate held in the plate holder.
Figure 8:
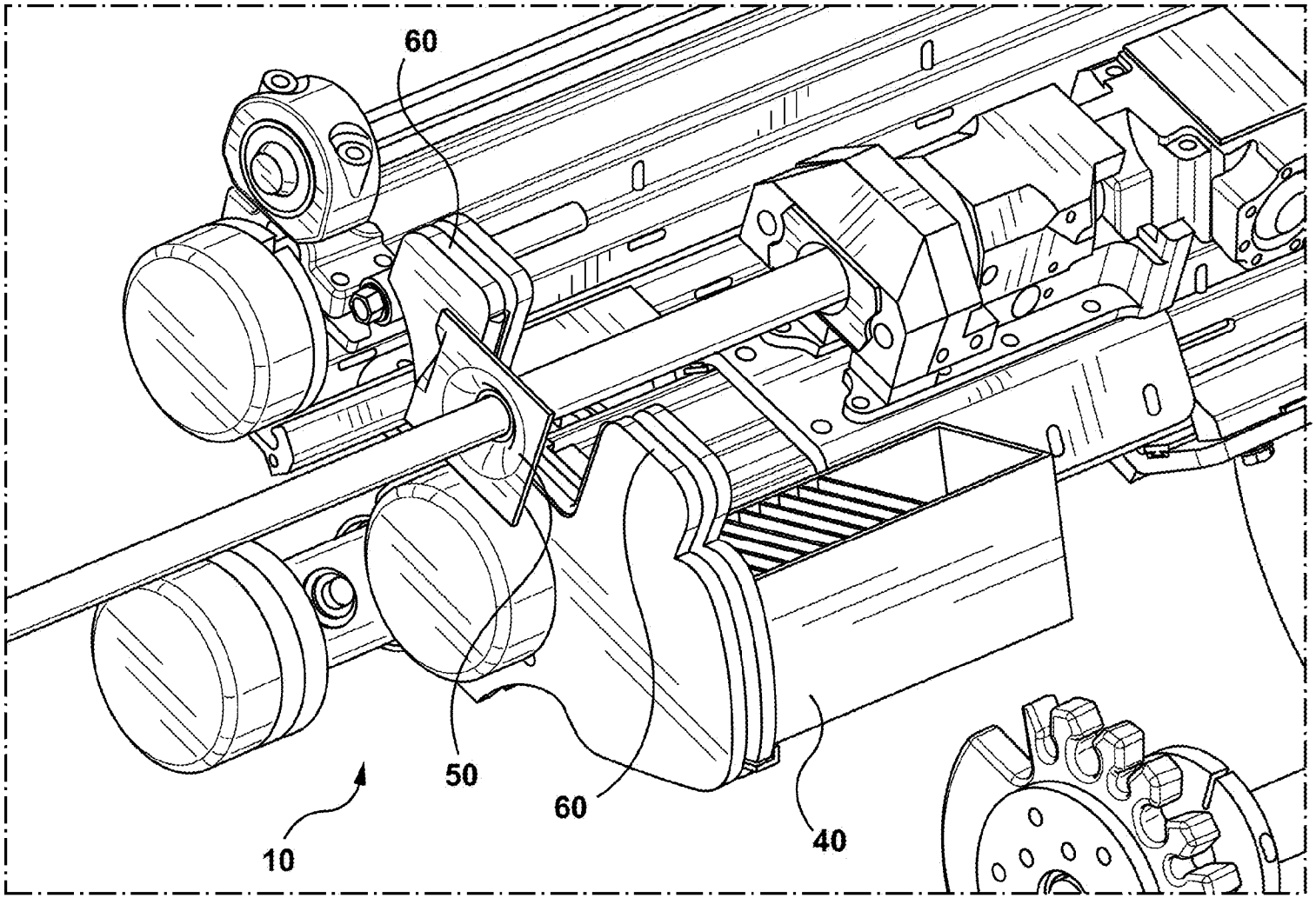
FIG. 8 depicts the plate after it has been pushed beyond the plate holder so that the plate thereafter travels with the advancing bolt.

As illustrated by way of example in FIG. 1, the bolter head indexes into a bolt-loading position. The bolter head indexes into the bolt-loading position after the drill string has drilled a hole in the rock face. A bolting carousel shown by way of example in FIG. 2 then rotates to load the bolt into position. The centralizer plate holder moves into the plate loading position as shown in FIG. 3 in front of the plate magazine where the next plate is loaded into place. Then the centralizer plate holder moves into the centralizer position as shown in FIG. 4 for the bolting operation. The drill then pushes the bolt through the plate enough to hold the bolt in position as shown in FIG. 5. The bolting head then indexes into the bolting position as shown in FIG. 6. The drill is moved forward to push the bolt into the wall for installation. FIG. 7 depicts the bolt advancing through the plate with the plate held in grooves of the plate holder. The bolt 30 has a thicker rear portion 31 of larger diameter than the hole in the plate. This thicker portion 31 of the bolt abuts the plate because its diameter is too wide to slide through the hole in the plate. The bolt thus dislodges the plate from the holder. FIG. 8 depicts the plate after it has been forced out of the holder. The unrestrained plate thereafter travels with the advancing bolt.

Figure 9:
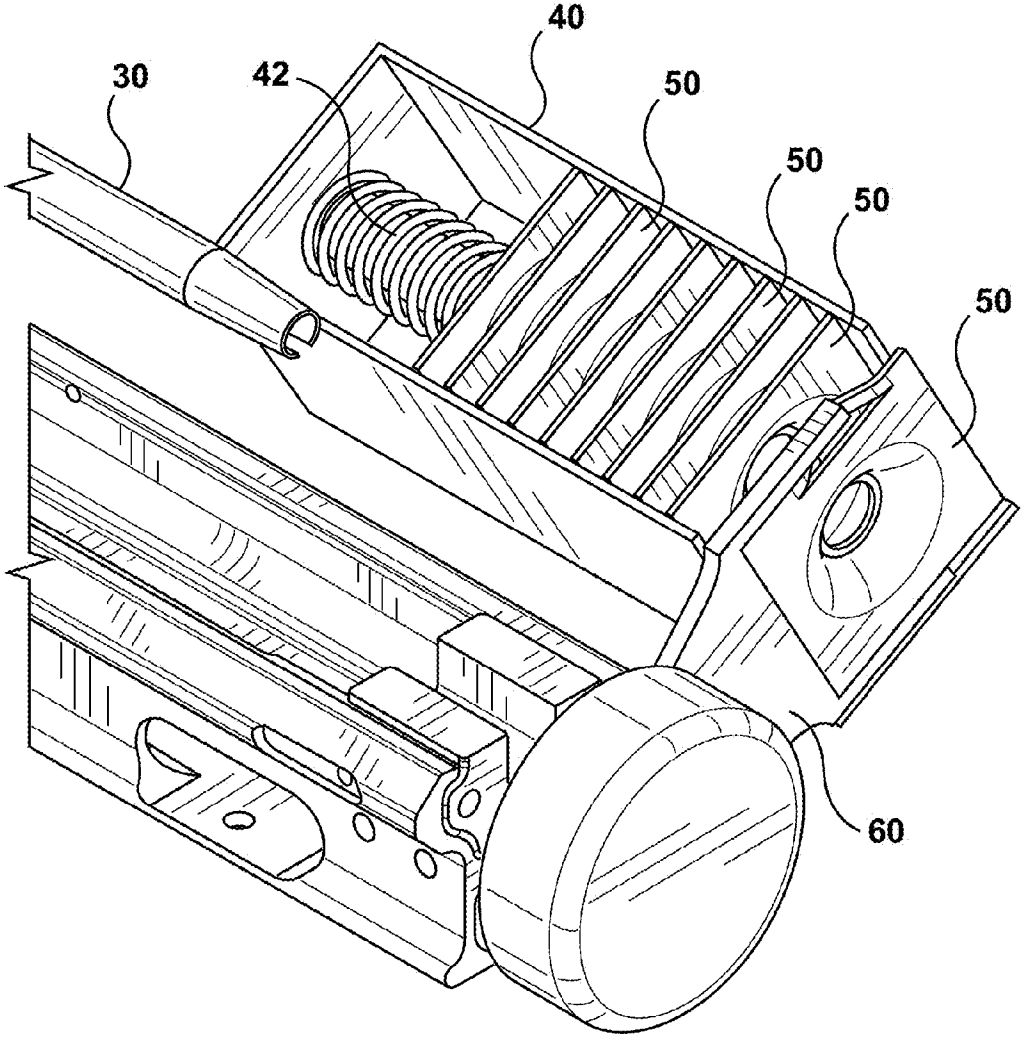
FIG. 9 depicts a rotary plate loader assembly.

FIG. 9 depicts a rotary plate loader assembly in accordance with one embodiment of the invention. Nine plates 50 are shown in the magazine 40 with a tenth plate 50 being held in a rotary holder 60. The number of plates may be varied in other embodiments. Although a coil spring 42 is illustrated in FIG. 9 as a means to urge the plates toward the exit, any other suitable tensile device may be substituted.

Figure 10:
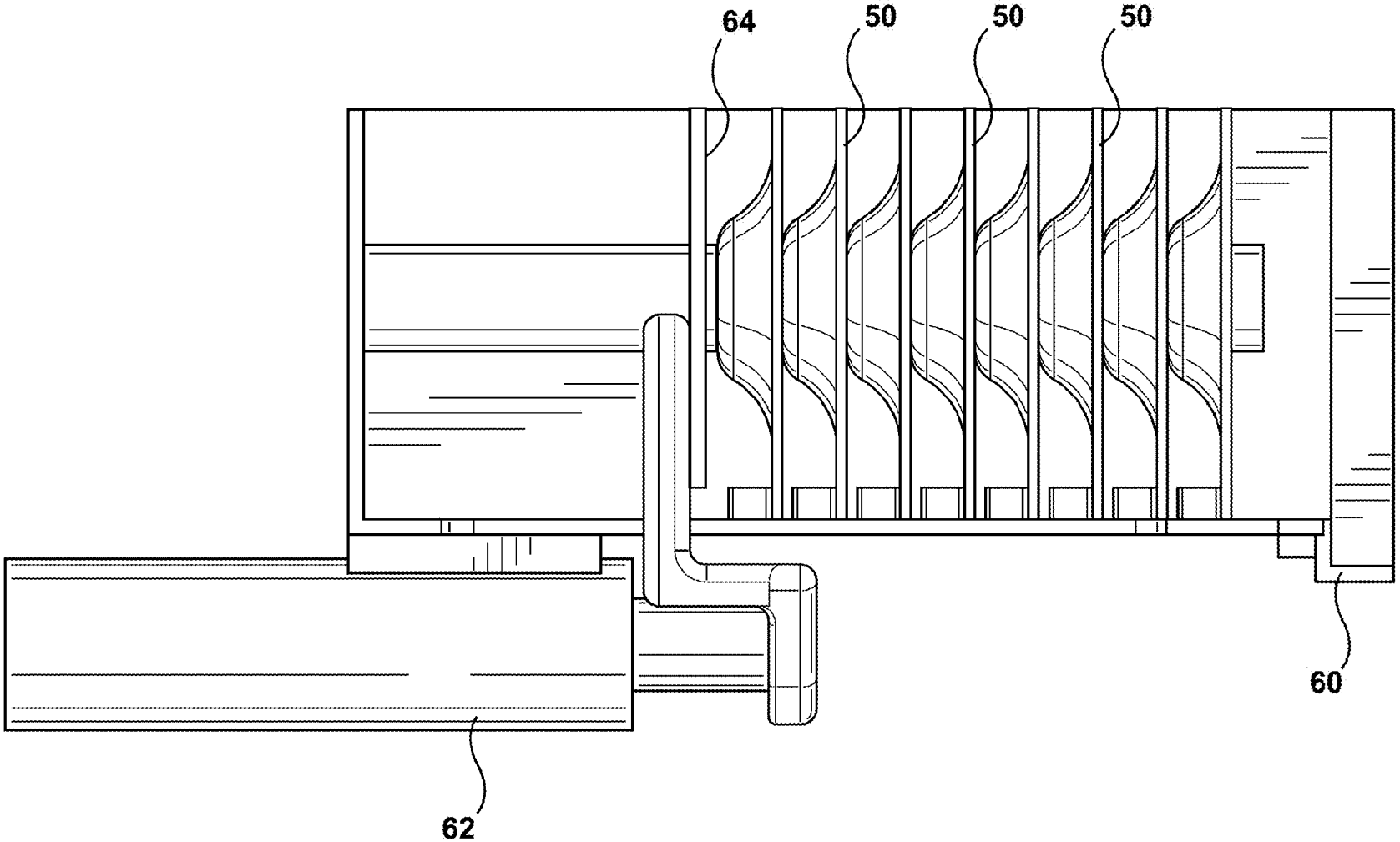
FIG. 10 depicts a hydraulically or pneumatically fed plate magazine.

FIG. 10 depicts a hydraulically or pneumatically fed plate magazine 40 in accordance with another embodiment of the invention. An actuator 62 drives a push plate 64 to advance the stack of plates toward the holder 60.

Figure 11:
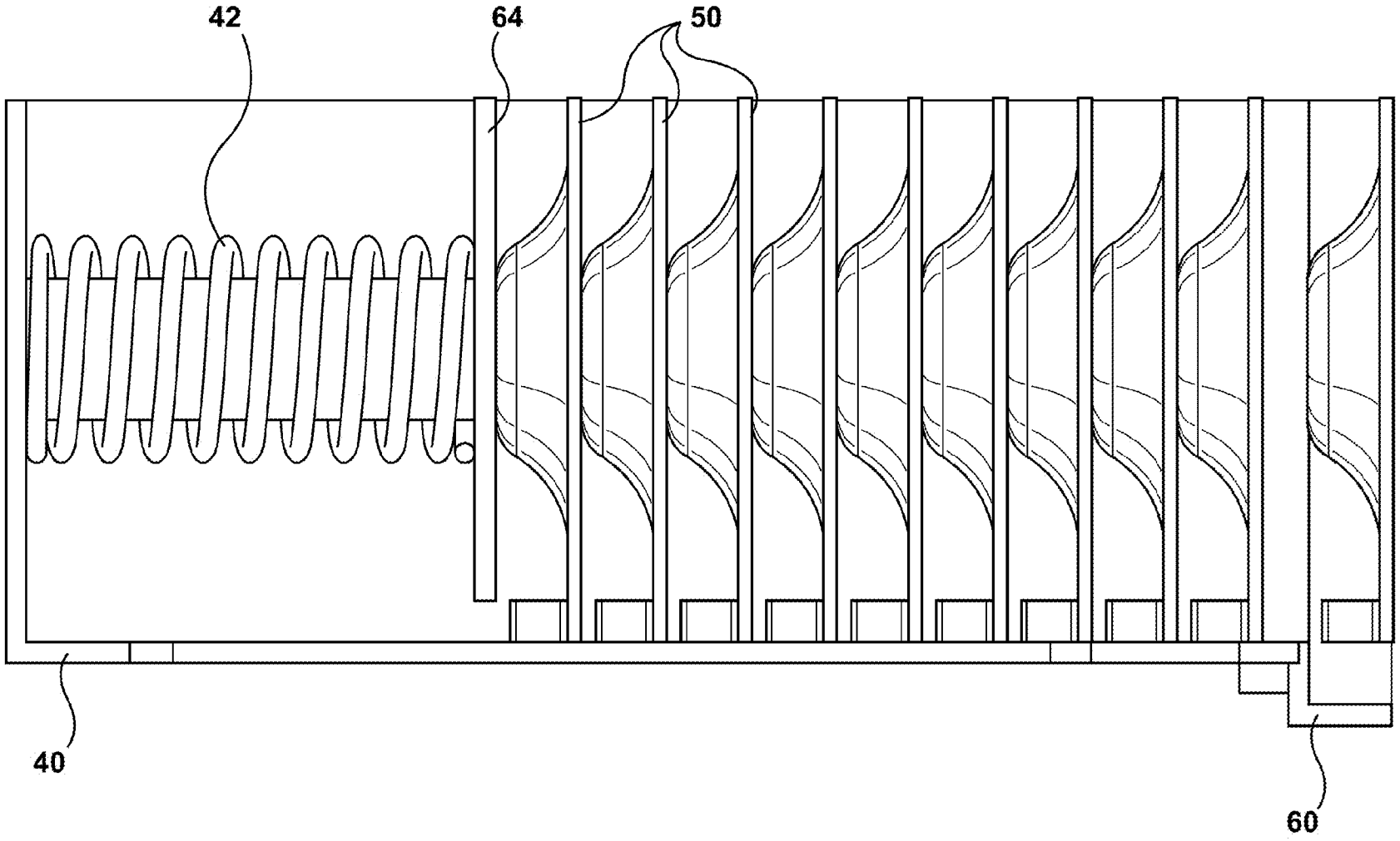
FIG. 11 depicts a spring-fed plate magazine.

FIG. 11 depicts a spring-fed plate magazine 40 in accordance with another embodiment of the invention. The spring presses against the push plate 64 to force the stack of plates toward the holder 60.

Figure 12:
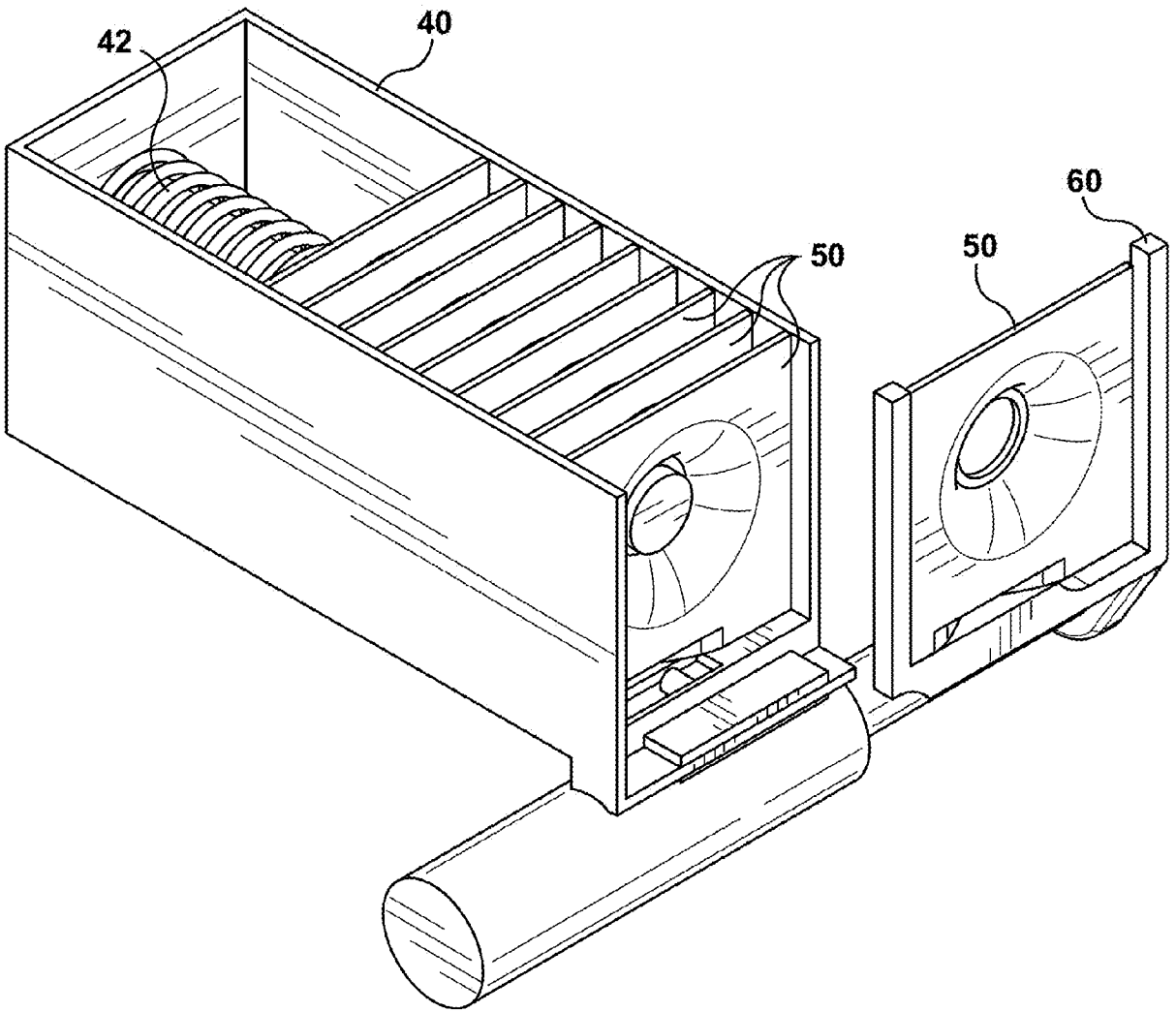
FIG. 12 depicts a linearly actuated plate feed.

FIG. 12 depicts a linearly actuated plate feed in accordance with another embodiment of the invention. A spring 42 mounted inside the magazine 40 forces the stack of plates 50 toward the exit. An actuator 62 displaces the holder 60 and a plate 50 held within the holder 60 along an axis that is orthogonal (perpendicular) to the axis defined by the spring.

Figure 13:
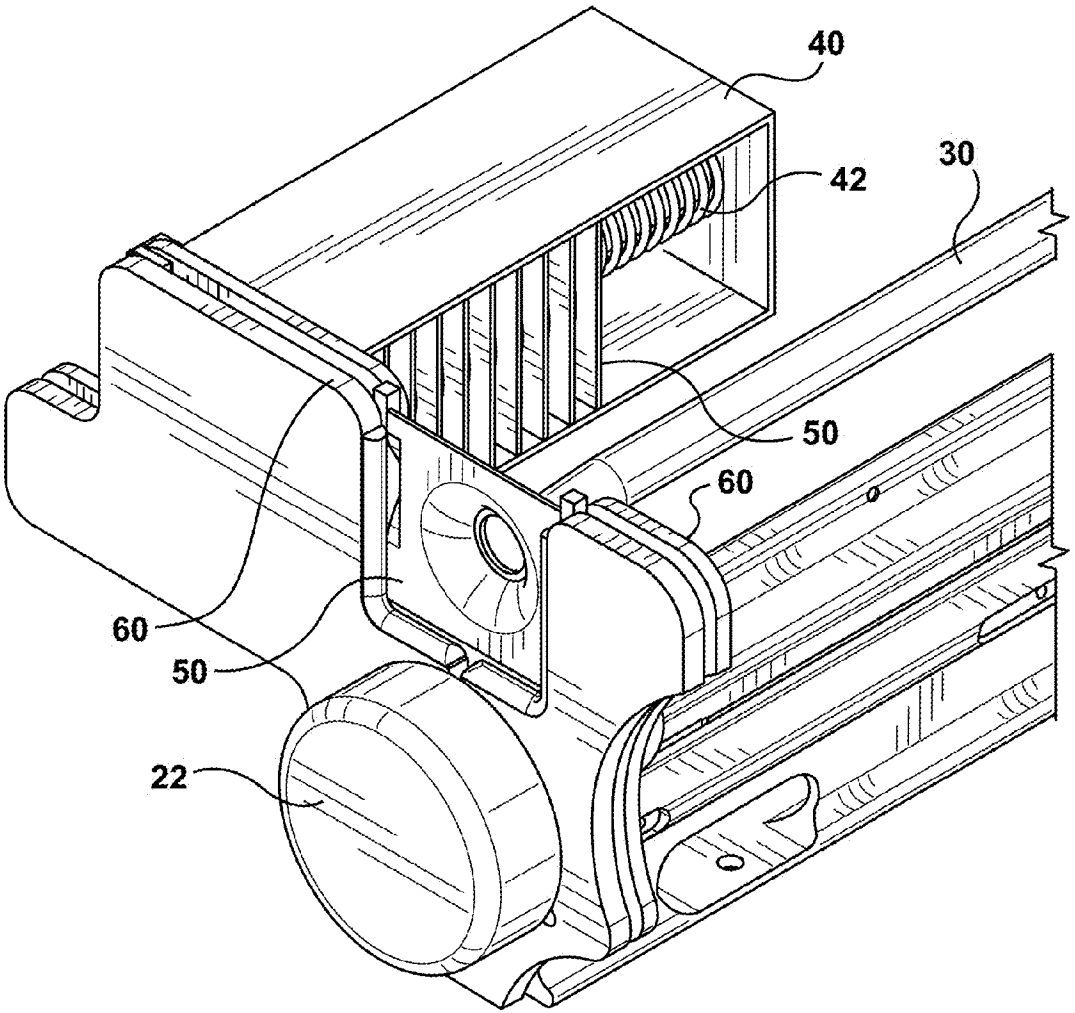
FIG. 13 depicts a linearly actuated plate loader assembly.

FIG. 13 depicts a linearly actuated plate loader assembly in accordance with another embodiment of the invention.

Method of Operation for Manual Loading

Figure 14:
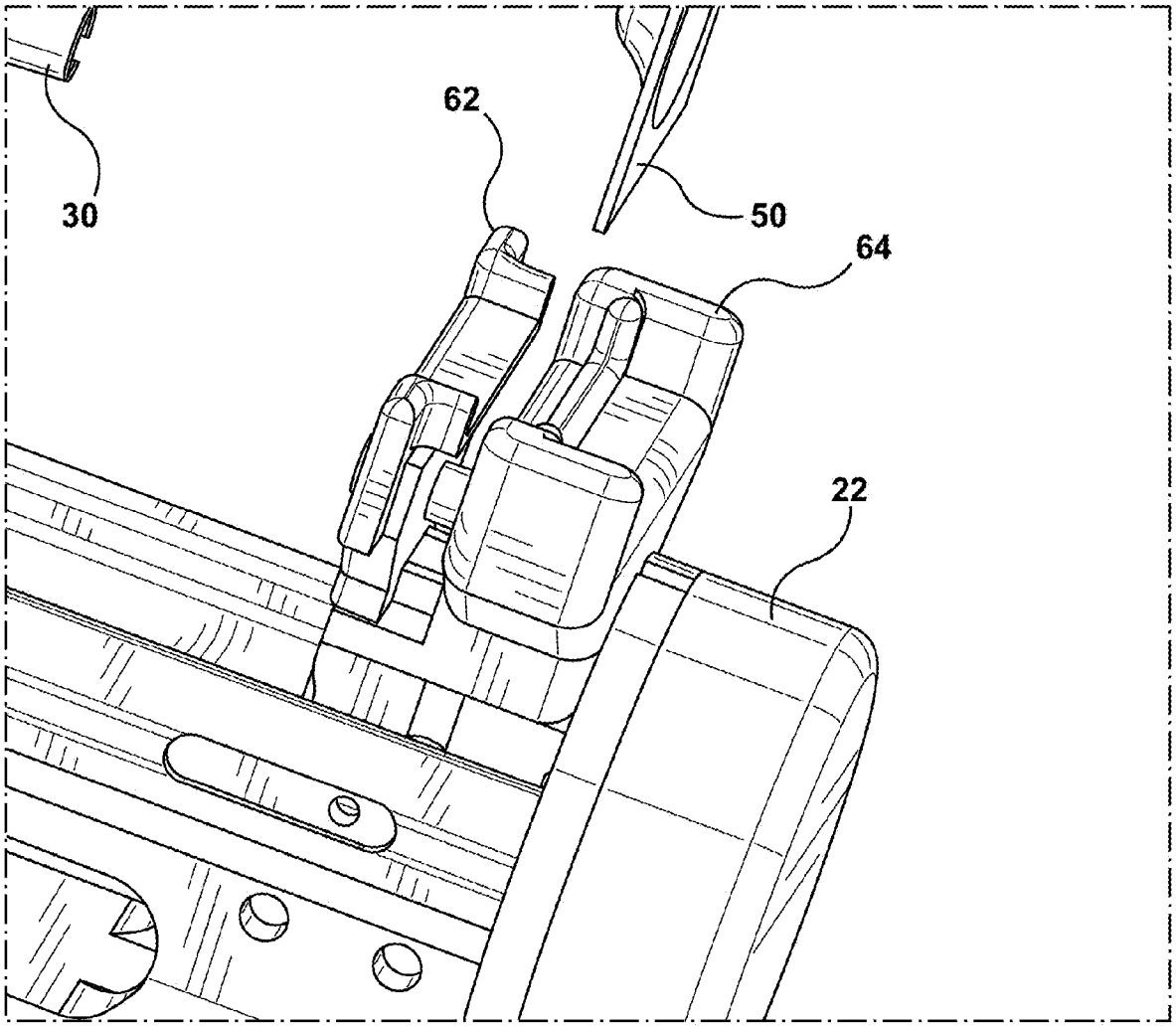
FIG. 14 is a first perspective view of a manual plate loading centralizer loading a plate.
Figure 15:
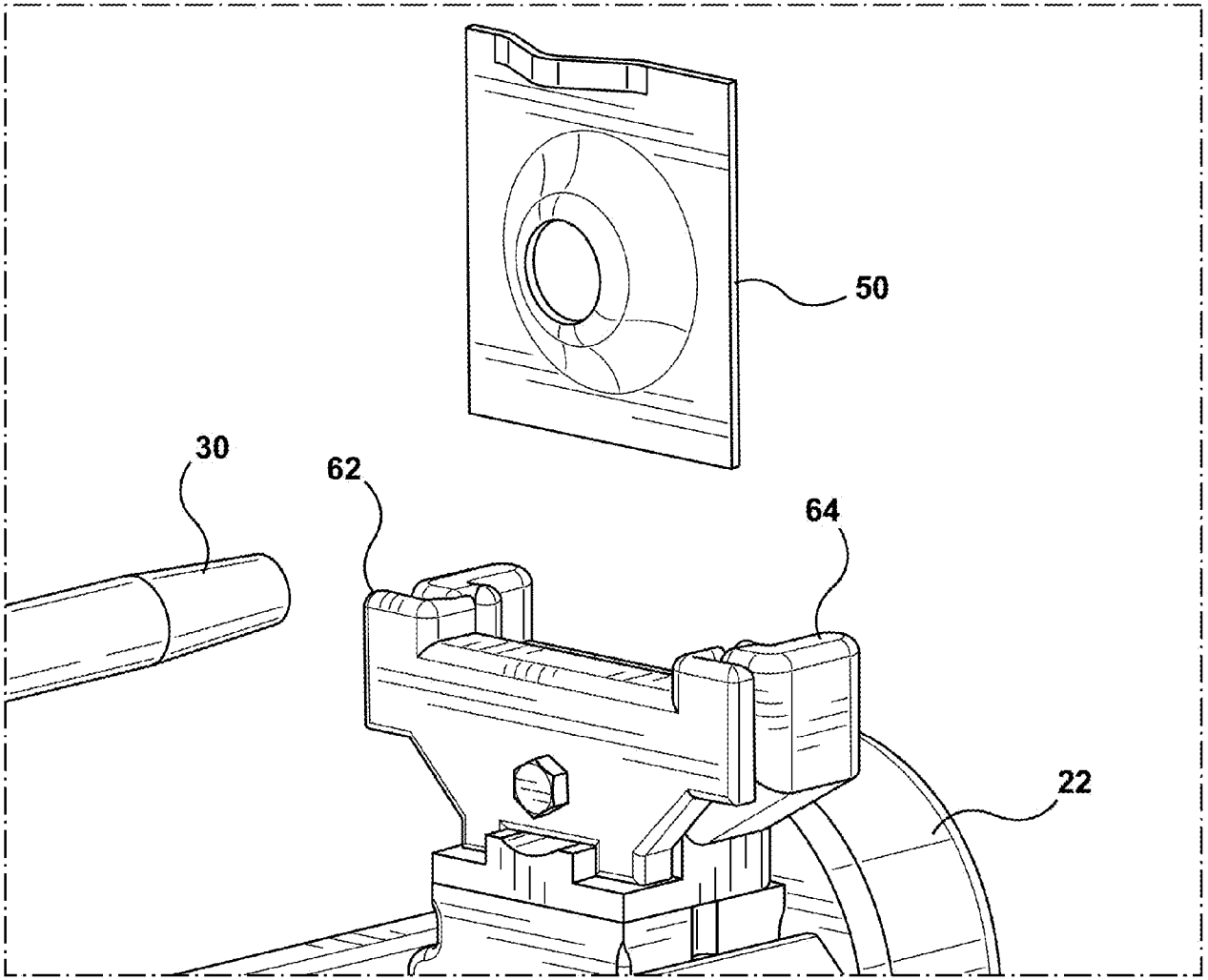
FIG. 15 is a second perspective view of the manual plate loading centralizer loading the plate.
Figure 16:
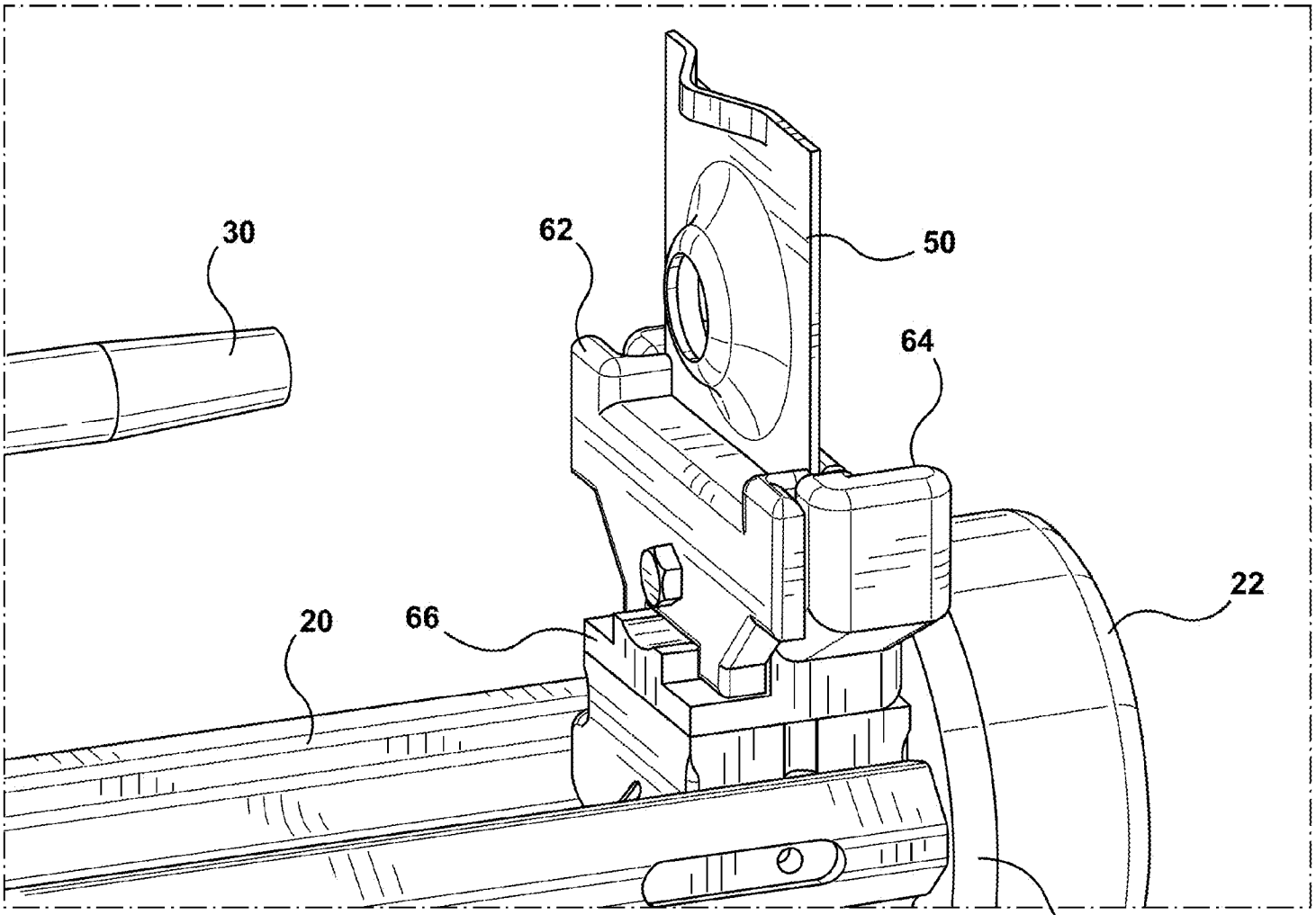
FIG. 16 depicts the manual plate loading centralizer with the plate locked into place.
Figure 17:
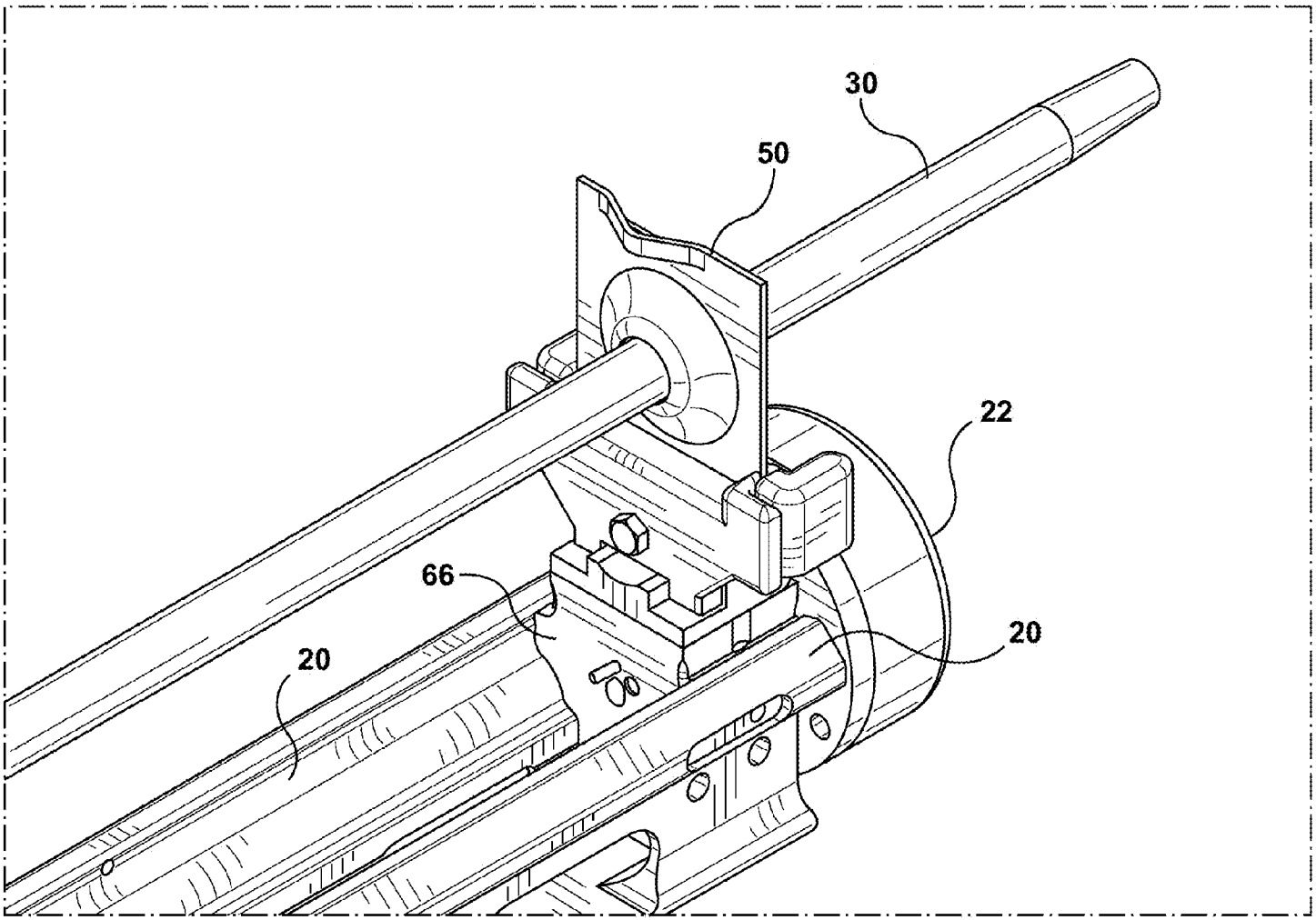
FIG. 17 depicts the manual plate loading centralizer providing the centralizer function to centralize the bolt.
Figure 18:
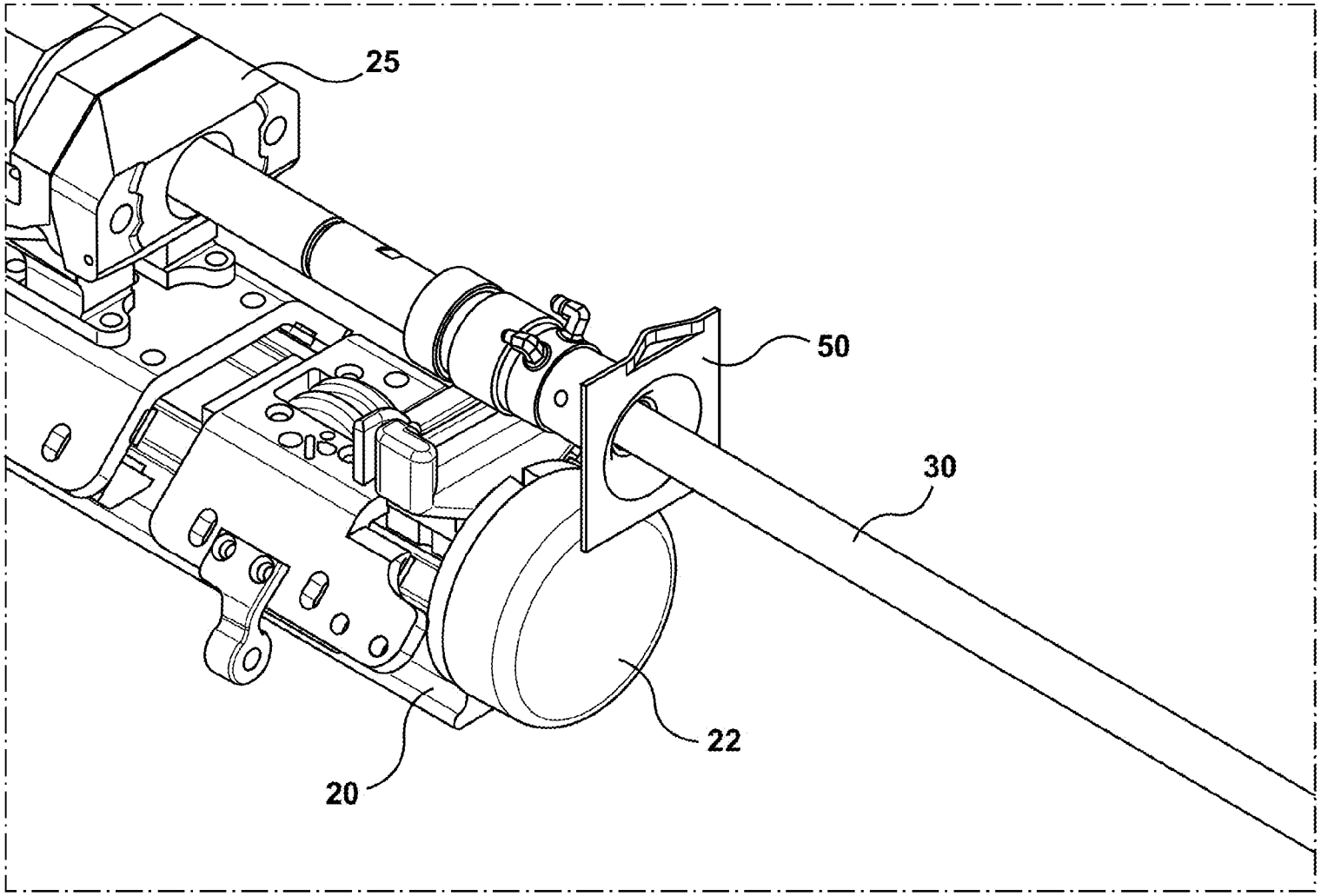
FIG. 18 is a first perspective view of the manual plate loading centralizer depicting the plate unloaded.
Figure 19:
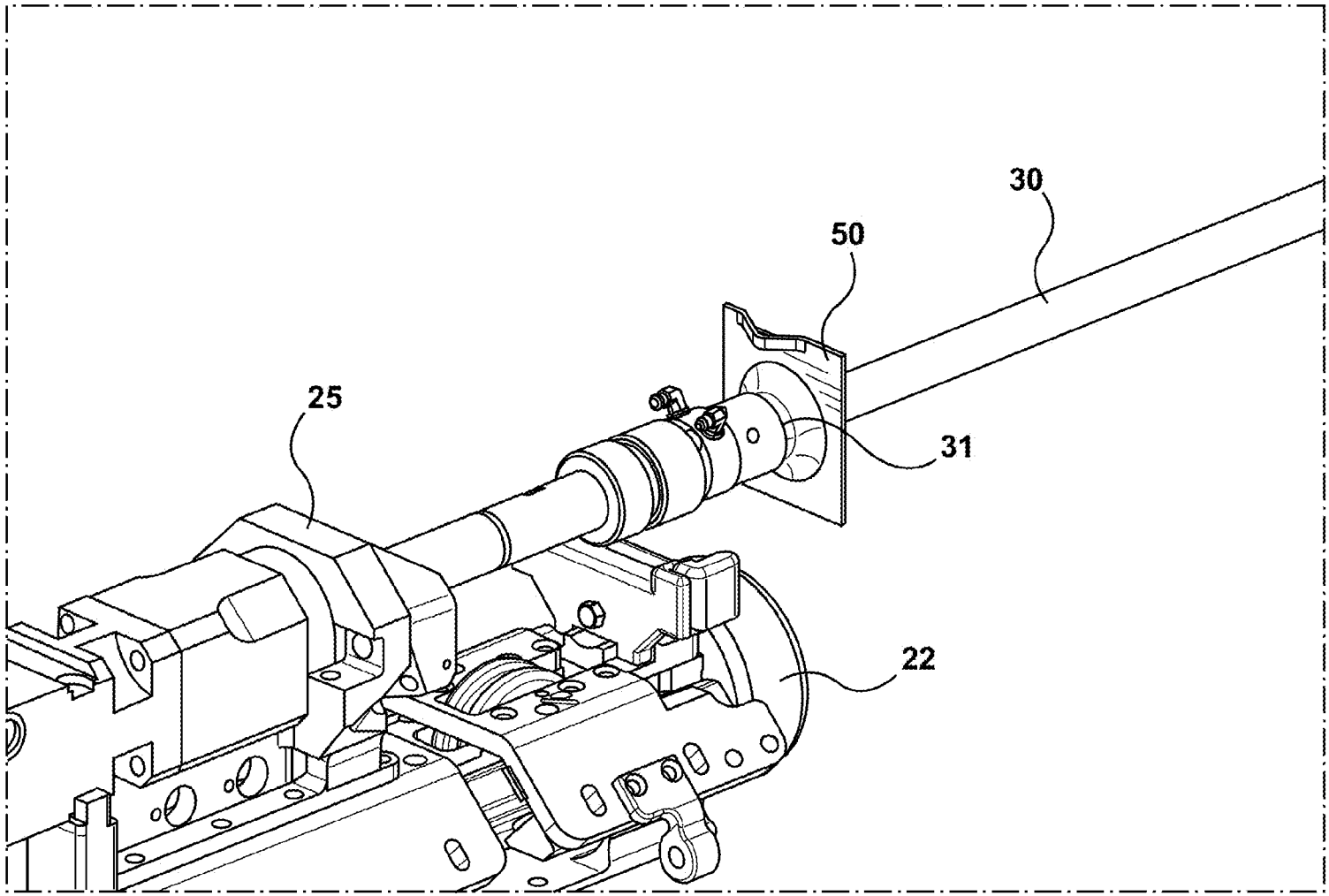
FIG. 19 is a second perspective view of the manual plate loading centralizer depicting the plate unloaded.

Manual loading is similar to the automatic loading using the plate magazine; however, instead of loading the plate using an actuation mechanism, the plate is loaded manually by the operator. In the illustrated embodiment, a back plate 62 is pulled back away from front portion 64 to open the plate holder as depicted by way of example in FIG. 14. The operator then loads the plate 50 into position by hand as depicted in FIG. 15. Once the plate is loaded, the back plate can be locked into position to lock the plate into the holder as shown in FIG. 16 so that it does not fall out or move during any orientation of the bolter. The bolt is then loaded into the plate where the plate will act as a centralizer to hold the bolt in position as depicted in FIG. 17. Once the drifter (bolting feed) pushes the bolt up to the plate, the plate will be pushed out of the holder to be installed against the wall (rock face) as shown in FIG. 18 and FIG. 19. As shown in FIG. 16, the holder, which is composed of the back plate 62 and the front portion 64, is supported on a base 66 that fits inside the bolter feed rail 20. In the illustrated embodiment, the base 66 is disposed in the most forward position possible in the rail, i.e. abutting the rear face of the disk-shaped pad support 22*a*.

Figure 20:
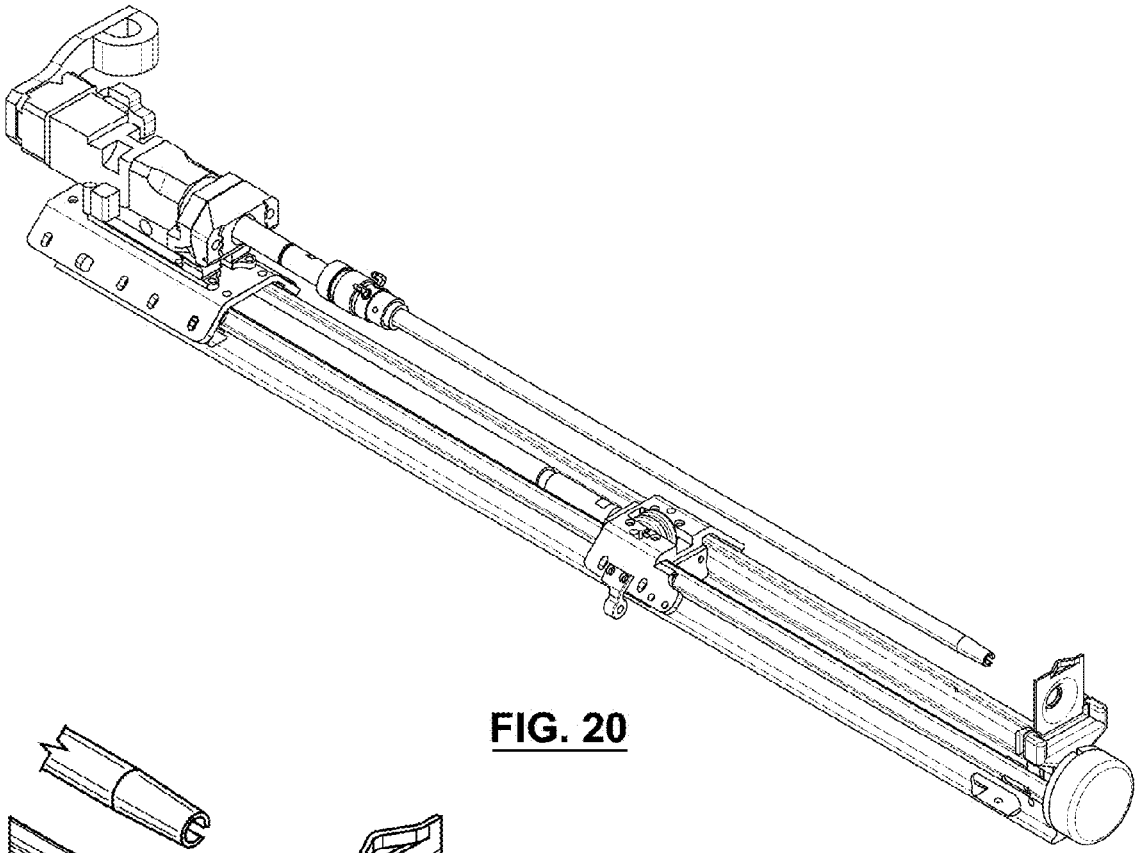
FIG. 20 depicts a manual loader assembly on a rock bolting system.
Figure 20A:
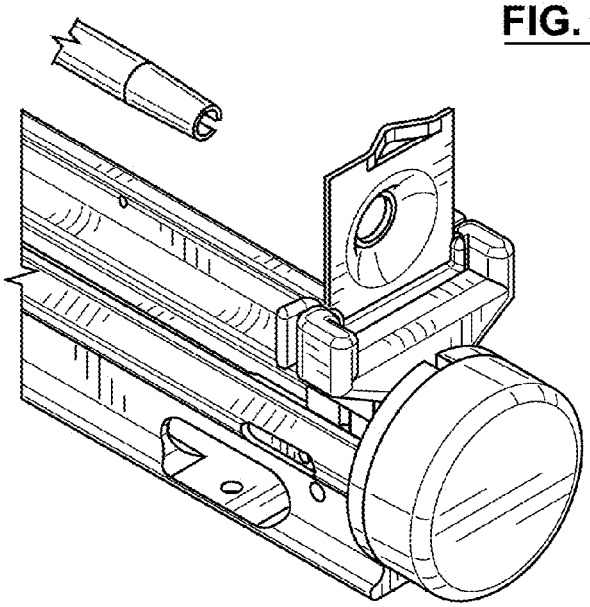
FIG. 20A depicts an enlarged view (detail A) of the manual loader assembly on the forward end of the rock bolting system.
Figure 20B:
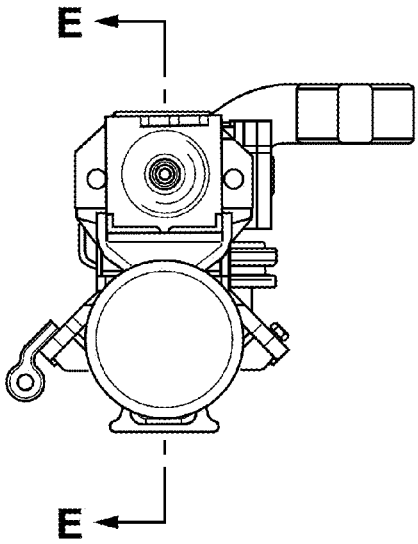
FIG. 20B is a front view of the rock bolting system showing the manual loader assembly.
Figure 20F:
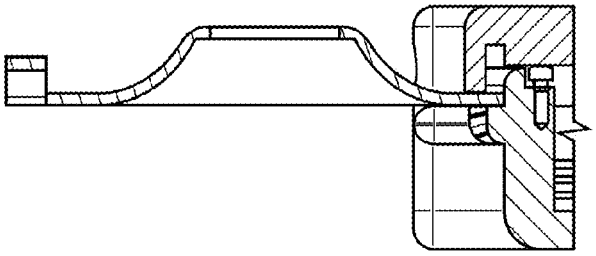
FIG. 20F is an enlarged view (detail F) of the holder holding a plate.
Figure 20D:
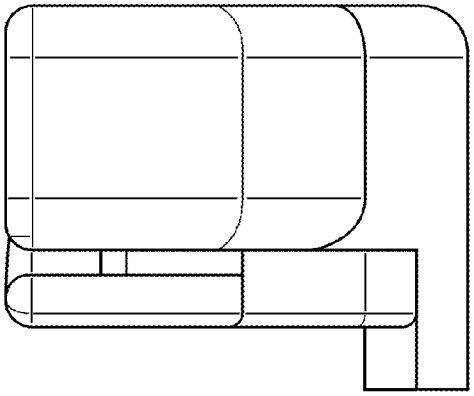
FIG. 20D shows the holder in a closed position.
Figure 20C:
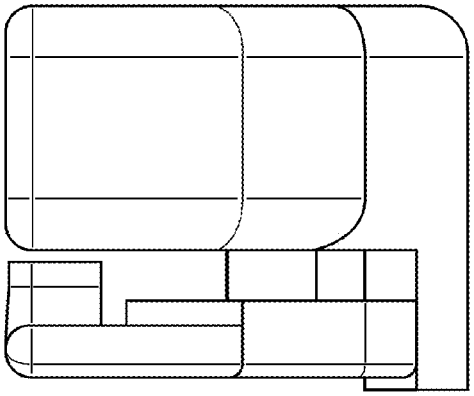
FIG. 20C shows a holder in an open position.
Figure 20E:
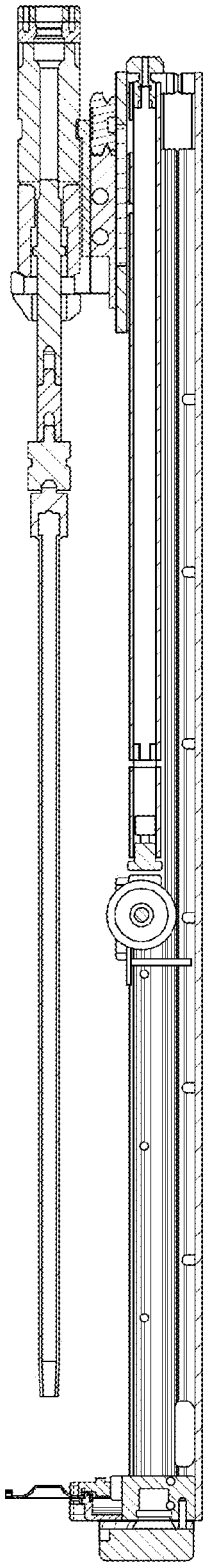
FIG. 20E is a cross-sectional view along section E-E.
Figure 21B:
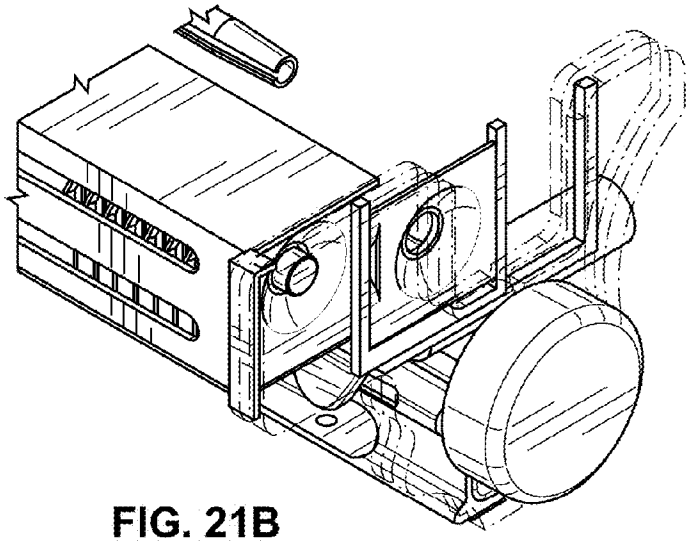
FIG. 21B is a perspective view of the linear plate loader assembly shifting the plate in the holder toward a bolt-receiving position.
Figure 21A:
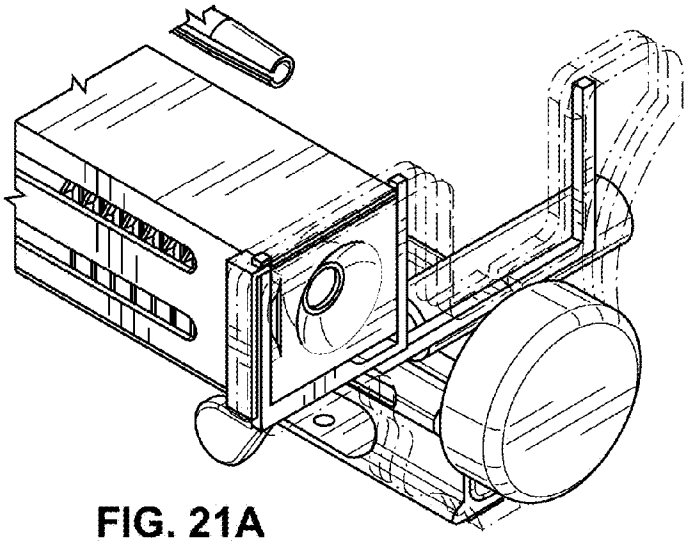
FIG. 21A is a perspective view of a linear plate loader assembly loading the plate in the holder.
Figure 21C:
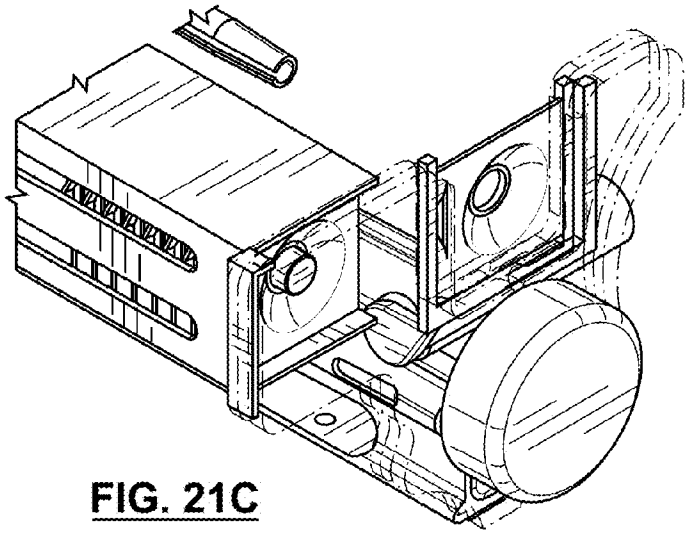
FIG. 21C is a perspective view of the linear plate loader assembly with the plate and holder in the bolt-receiving position.
Figure 21E:
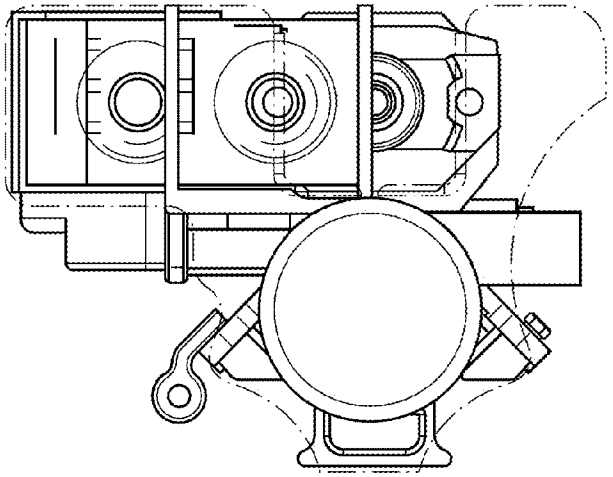
FIG. 21E is a front view of FIG. 21B.
Figure 21D:
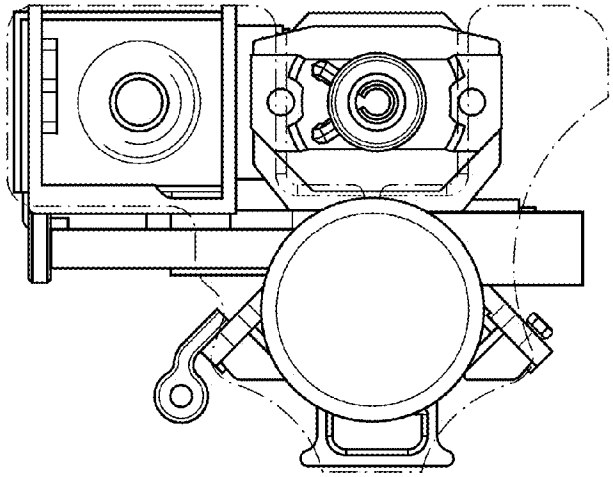
FIG. 21D is a front view of FIG. 21A.
Figure 21F:
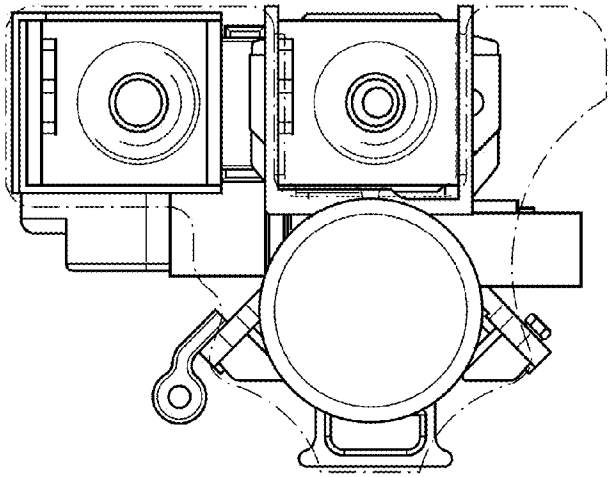
FIG. 21F is a front view of FIG. 21C.
Figure 22B:
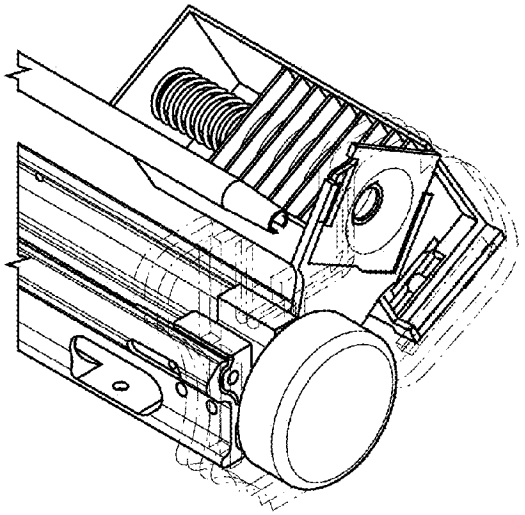
FIG. 22B is a perspective view of a rotary plate loader assembly rotating toward from the loading position toward the bolt-receiving position.
Figure 22C:
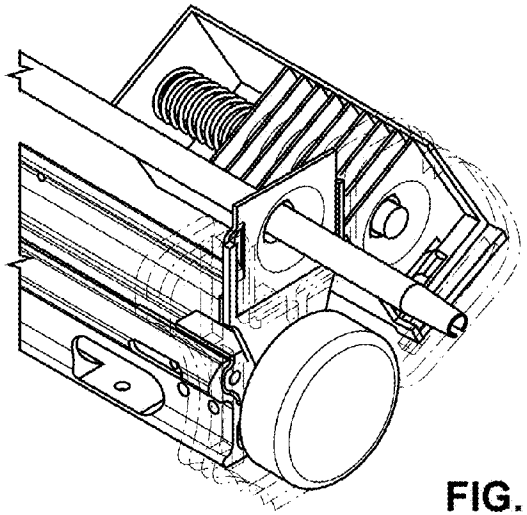
FIG. 22C is a perspective view of a rotary plate loader assembly in the bolt-receiving position.
Figure 22A:
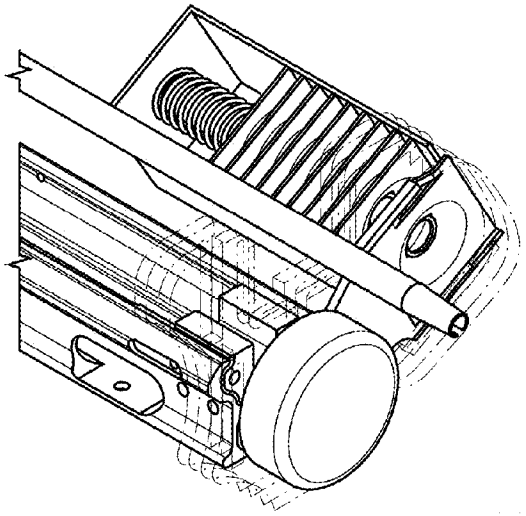
FIG. 22A is a perspective view of a rotary plate loader assembly in loading position.
Figure 22E:
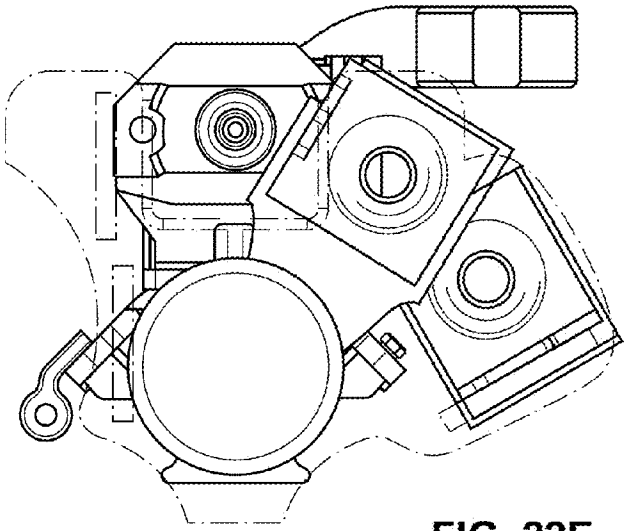
FIG. 22E is a front view of FIG. 22B.
Figure 22D:
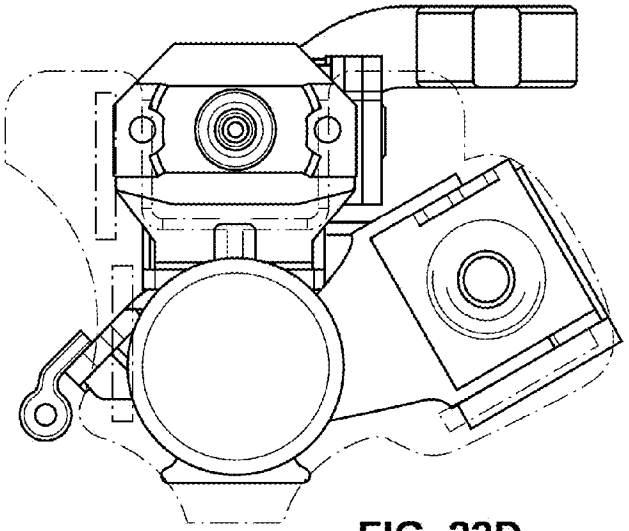
FIG. 22D is a front view of FIG. 22A.
Figure 22F:
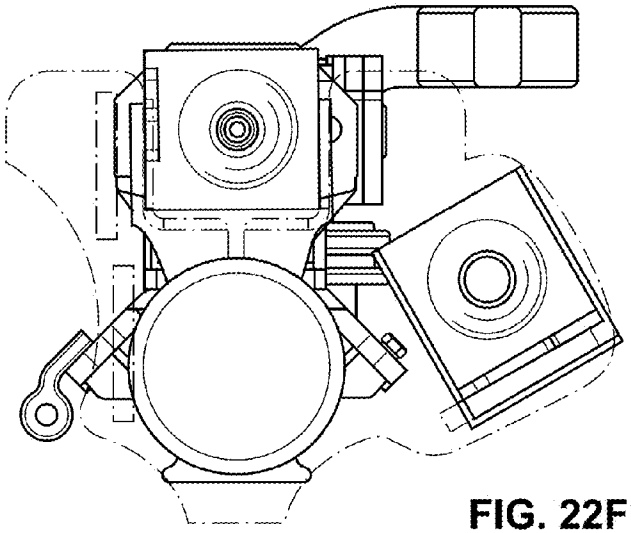
FIG. 22F is a front view of FIG. 22C.

Additional details of the manual loading assembly are shown in FIG. 20 as well as FIGS. 20A-20E. The back plate and front portion are shown in open and closed positions, i.e. loading and loaded positions.

Additional details of the manual loading assembly are shown in FIGS. 21A-21F. This set of figures shows how the magazine releases a plate into a holder that then slides transversely into position for receiving the bolt through its hole.

Additional details of the manual loading assembly are shown in FIGS. 22A-22F. This set of figures shows how the magazine releases a plate into a holder that rotates about an axis of rotation parallel to the drill feed. The holder rotates the plate into alignment with the rock bolt.

The present invention has been described in terms of specific embodiments, examples, implementations and configurations which are intended to be exemplary or illustrative only. Other variants, modifications, refinements and applications of this innovative technology will become readily apparent to those of ordinary skill in the art who have had the benefit of reading this disclosure. Such variants, modifications, refinements and applications fall within the ambit and scope of the present invention. Accordingly, the scope of the exclusive right sought by the Applicant for the present invention is intended to be limited solely by the appended claims and their legal equivalents.

The invention claimed is:

1. A rock bolting system comprising:
- a frame supporting a movable bolter feed rail;
- a bolter feed slidable on the bolter feed rail, the bolter feed for driving a rock bolt into a drilled hole in a rock face;
- a plate magazine for storing a plurality of bolt plates; and
- a plate holder for holding one of the plates by holding at least two sides of the plate to enable the plate being held to function as a centralizer to centralize the bolt, wherein the plate holder is movable with respect to the plate magazine between a first position in which the plate holder is aligned with the plate magazine and a second position in which the plate holder is aligned with the bolter feed.

2. The system as claimed in claim 1 further comprising a spring to press a stack of plates toward the plate holder.

3. The system as claimed in claim 1 further comprising:
- a spring mounted inside the magazine to force the plates along a first axis toward an exit of the magazine; and
- an actuator to displace the holder along a second axis that is orthogonal to the first axis.

4. A method of installing a rock bolt using a rock bolting system having a frame supporting a movable bolter feed rail upon which a bolter feed is slidable, the method comprising:
- storing a plurality of bolt plates in a plate magazine;
- holding one of the plates in a plate holder by holding at least two sides of the plate to enable the plate being held to function as a centralizer to centralize the bolt;
- moving the plate holder with respect to the plate magazine from a first position in which the plate holder is aligned with the plate magazine to a second position in which the plate holder is aligned with the bolter feed; and
- driving the rock bolt into a hole in a rock face by driving the rock bolt through a hole in the plate until a thicker rear portion of the bolt dislodges the plate from the holder.

5. The method as claimed in claim 4 further comprising automatically loading the plate from the magazine into the plate holder using a spring to press a stack of plates toward the holder.

6. The method as claimed in claim 4 further comprising:
- forcing the plates along a first axis toward an exit of the magazine; and
- displacing the holder along a second axis that is orthogonal to the first axis.

7. A rock bolting system comprising:
- a frame supporting a movable bolter feed rail;
- a bolter feed slidable on the bolter feed rail, the bolter feed for driving a rock bolt into a drilled hole in a rock face;
- a plate magazine for storing a plurality of bolt plates; and a plate holder for holding one of the plates by holding at least two sides of the plate to enable the bolt to engage the plate being held, wherein the plate holder is movable with respect to the plate magazine between a first position in which the plate holder is aligned with the plate magazine and a second position in which the plate holder is aligned with the bolter feed.

8. The system as claimed in claim 7 further comprising a spring to press a stack of plates toward the plate holder.

9. The system as claimed in claim 7 further comprising:

a spring mounted inside the magazine to force the plates along a first axis toward an exit of the magazine; and an actuator to displace the holder along a second axis that is orthogonal to the first axis.

* * * * *